United States Patent [19]

Staples

[11] 3,944,986

[45] Mar. 16, 1976

[54] VEHICLE MOVEMENT CONTROL SYSTEM FOR RAILROAD TERMINALS

[75] Inventor: Crawford E. Staples, Edgewood, Pa.

[73] Assignee: Westinghouse Air Brake Company, Swissvale, Pa.

[22] Filed: Jan. 16, 1974

[21] Appl. No.: 433,775

Related U.S. Application Data

[63] Continuation-in-part of Ser. No. 124,270, March 15, 1971, abandoned, and a continuation-in-part of Ser. No. 830,767, June 5, 1969, abandoned, said Ser. No. 124,270, Continuation-in-part of Ser. No. 830,767.

[52] U.S. Cl. ..... 340/172.5

[51] Int. Cl.[2] ..... G06F 15/48

[58] Field of Search ..... 340/172.5, 147 P; 444/1; 235/150.2, 150.24; 104/26 R, 88; 246/3, 4, 5, 167 R; 325/53, 55, 64

[56] References Cited

UNITED STATES PATENTS

| | | | |
|---|---|---|---|
| 3,314,051 | 4/1967 | Willcox et al. | 340/172.5 |
| 3,562,431 | 2/1971 | Inose et al. | 325/55 |

OTHER PUBLICATIONS

Sargent, W. H., "Real Time Wagon Progress Control," *The Computer Bulletin*, Vol. 10, Issue 1, June 1966, pp. 27–31.

Wolfenden, K. & Wren, A. "Locomotive Scheduling by Computer", *British Joint Computer Conference, 1966, pp. 31–37.*

*Primary Examiner*—Raulfe B. Zache

*Attorney, Agent, or Firm*—R. W. McIntire, Jr.; H. A. Williamson; A. G. Williamson, Jr

[57] ABSTRACT

Data and voice communication links are provided between a movement direction center, a data processing center, and all mobile work units of a railroad terminal control system. A work assignment input from the movement direction center, e.g., an order to assemble a train, activates the data processing center to prepare and transmit to the selected switching locomotive an itemized work list, which is recorded in printed form at the locomotive to serve as specific instructions for accomplishing the assignment. The work unit crew reports readiness to begin and subsequent completion of each work list item. The data processing center responds to these and other information inputs, e.g., vehicle movement indications, to check the work done and to remotely establish the field conditions, e.g. track routes, necessary to accomplish the successive work items until the entire assignment is completed. The data processing center sets up the next route and authorizes the locomotive crew to perform the next work step only when the checking process indicates that the prior work step was correctly completed.

12 Claims, 5 Drawing Figures

INVENTOR
Crawford E. Staples.
BY

INVENTOR
Crawford E. Staples
BY

INVENTOR
Crawford E. Staples.
BY

INVENTOR
Crawford E. Staples.
BY

INVENTOR
Crawford E. Staples
BY

VEHICLE MOVEMENT CONTROL SYSTEM FOR RAILROAD TERMINALS

BACKGROUND OF THE INVENTION

This application is a continuation-in-part of my pending application Ser. No. 124,270, now abandoned, filed Mar. 15, 1971, and a continuation-in-part also of my prior application Ser. No. 830,767, filed June 5, 1969, now abandoned, application Ser. No. 124,270 in turn being a continuation-in-part of the original application, Ser. No. 830,767.

This invention relates to a vehicle movement control system for use in railroad terminals. More particularly, my invention relates to a remote control arrangement by which movement of all vehicles and operations of remote mobile work units, for example, switching locomotives, are directed and controlled from a central control headquarters in a railroad terminal area.

Railroad terminals designed particularly for freight train operations normally consist of receiving and departure yards, one or more classification yards, various servicing facilities for locomotives, cabooses, and freight cars, and industrial yards and tracks for serving local customers. Also included are various control headquarters and offices, mobile work units or crews, and communication facilities connecting all such locations and units in order to provide management control or supervision of the operations. Control systems for classification yards are already known in the railroad art and include such features as automatic switching systems for routing the cuts of cars to preselected storage tracks and automatic speed control apparatus for obtaining the proper coupling speeds between cars as they arrive at their selected storage location. Further, interlocking control systems for the entrance and exit switching matrices to a terminal area and for individual yard entrances are also known, including the remote control of such interlocking systems. However, many manual operations are still involved in the usual railroad terminal area. These include the delivery of written operational and work orders to switching crews and manually recording the operations performed and the movement of cars between yard locations to maintain a car location inventory. Further, each switching crew foreman controlling a switching locomotive in the various yards or serving nearby industries decides what procedure to follow, that is, the order of specific operations in moving cars. Also such crews must frequently return with their locomotives to a central location to receive subsequent orders for moving vehicles throughout the area. Obviously, this form of operations control does not result in the most efficient or economical order for the work items performed or the most efficient use of the facilities available. The manual procedures frequently require additional manpower and extra movements of the various locomotives and other type work units. This reduced efficiency and economy in the operations also adds to the total amount of apparatus actually needed, particularly locomotives for switching purposes. Improvement in efficiency and economy of terminal operations may be obtained if all vehicle movements are controlled and directed from one central location and specific work assignments are transmitted directly to the various mobile work units scattered throughout the area.

Accordingly, an object of my invention is a centralized vehicle movement control system for railroad terminal installations.

Another object of my invention is to provide within a railroad terminal control system a centralized vehicle movement control arrangement.

Also an object of this invention is a vehicle movement control system for railroad terminals in which a central data processing means selects and transmits specific work commands to remote mobile work units within the terminal area.

A further object of this invention is a method of controlling the operations of mobile work units in a railroad terminal area by selecting and transmitting itemized work command formats from a central data processing means at the control location to selected mobile units which perform the desired operations and by checking the correct performance of the assigned work by the vehicle movement information periodically reported to the central data processing means from the remote locations.

Still another object of the invention is a vehicle movement control system for railroad terminals in which a work assignment selected by a movement controller is translated into an itemized work format by a data processing means and transmitted to a selected remote mobile work unit where it is recorded in printed form as instructions to the work unit crew.

It is also an object of my invention to provide a method and apparatus for controlling the movement of cars in a railroad terminal area by which an itemized work list for efficiently accomplishing a series of desired car movements is determined by a central process control means and transmitted to a selected switching locomotive, which completes each work item in order as the necessary track routes are successively established by remote control by the central process control means in response to information transmitted from the switching locomotive as each item is completed and checked for correctness by the central process control means.

Another object of my invention is an arrangement for controlling the movement of cars in a railroad terminal area including a central data processing control means, switching locomotives with data recording and transmission devices, a terminal communication system, and track route control apparatus wherein the central processing means translates desired car movements into a series of work items which are transmitted as a printed itemized format to the selected switching locomotive whose crew performs each work item in listed order, reporting completion of each item to the central processing means, which checks the correctness of the completed work and responds by transmitting a route control to position wayside apparatus to establish the track route required for the next work movement if the previous work has been correctly performed.

Other objects, features, and advantages of my invention will become apparent from the following description when taken in connection with the accompanying drawings and appended claims.

SUMMARY OF THE INVENTION

In practicing my invention, I add the novel vehicle movement control arrangement to the automatic control system provided for classification yards in a railroad terminal area. Such class yard control systems normally include a central data processing means, automatic speed control apparatus for obtaining proper car coupling speeds, and an automatic switching system for routing cars to the desired storage tracks. The automatic speed control and switching apparatus is controlled by the central processing means which includes a computer portion programmed for determining the leaving speed for the various cars from the car retarders in accordance with the car parameters previously measured and recorded. As part of the yard control operations arrangement, an inventory by serial number of the cars occupying the storage tracks of the yard is also maintained by the data processing means with the car numbers recorded by any known kind of manual or automatic car identification system. Various parameters of the classified cars, such as length, number of wheels, and weight, are also stored in the data processing arrangement. This type of yard control system is already known in the art in several different specific forms.

To all of this, I add a movement control center with input/output means associated with the central data processing means in order to read out car and locomotive location information and for input of designated work assignments, such as vehicle movements, to be accomplished in the terminal area. I also add to the existing communication system a digital arrangement having a data transmission capability. This involves, of course, adding such a capability over whatever radio communication channels are already in use to contact the various types of remote mobile work units and personnel scattered throughout the terminal area. Further, each such mobile work unit, for example, a switching locomotive and crew, is provided with digital and voice communication apparatus to receive and transmit data and voice messages. The incoming data is recorded by a printer device aboard the work unit or locomotive as an itemized work command to the work unit foreman. The transmitter for returning information to the central location is part of a portable communication device provided for the foreman, conductor, or chief of the work crew. This individual carries the portable unit providing two-way voice and data transmission communications with the movement control headquarters and with the central processing unit.

The input of the work assignment or vehicle movement command into the central processing unit activates the preparation of a work list format which is transmitted to the selected mobile work unit which may best accomplish the work assignment. The work command format is an item-by-item list in the sequential order that is to be followed in performing the assigned task. If vehicle movements are involved, for example, the switching of railroad cars, the format lists in order the movements that are to be made by the switching locomotive to complete the assignment in the most efficient and economical manner. The foreman of the mobile work unit transmits a signal to the central processing unit as each item of the work list is completed. If a vehicle movement is involved in one of the yards of the terminal, the processing unit transmits control functions to establish the required track route, each new set of control functions being transmitted as the previous item on the work list is completed and so reported. When movement of cars is involved, such movement is automatically detected and reported from the various field locations by apparatus supplied throughout the yard and is recorded in the processing unit as information functions are received. The reception of such information enables the central processing unit, using previously stored car parameter data, the car inventory, and the received work completed reports, to check that each work list item has been done correctly. If there is any inconsistency between the assigned vehicle movements and those reported and correlated with the stored inventory, a new route can not be established until the inconsistency or error is corrected. The necessary corrective action is determined and instructions transmitted to the locomotive and crew involved. The work unit foreman also has voice communication with the movement direction center to enable exceptions to routine operations to be quickly handled. The information reported into the central processing means is also available for readout to movement direction headquarters to follow and check progress throughout the terminal area when exceptions occur and upon completion of assigned tasks.

RESUME OF THE DRAWINGS

I shall now describe in more specific detail a railroad terminal vehicle movement control system embodying one form of my invention, referring from time to time to the accompanying drawings in which.

Figure 3A:
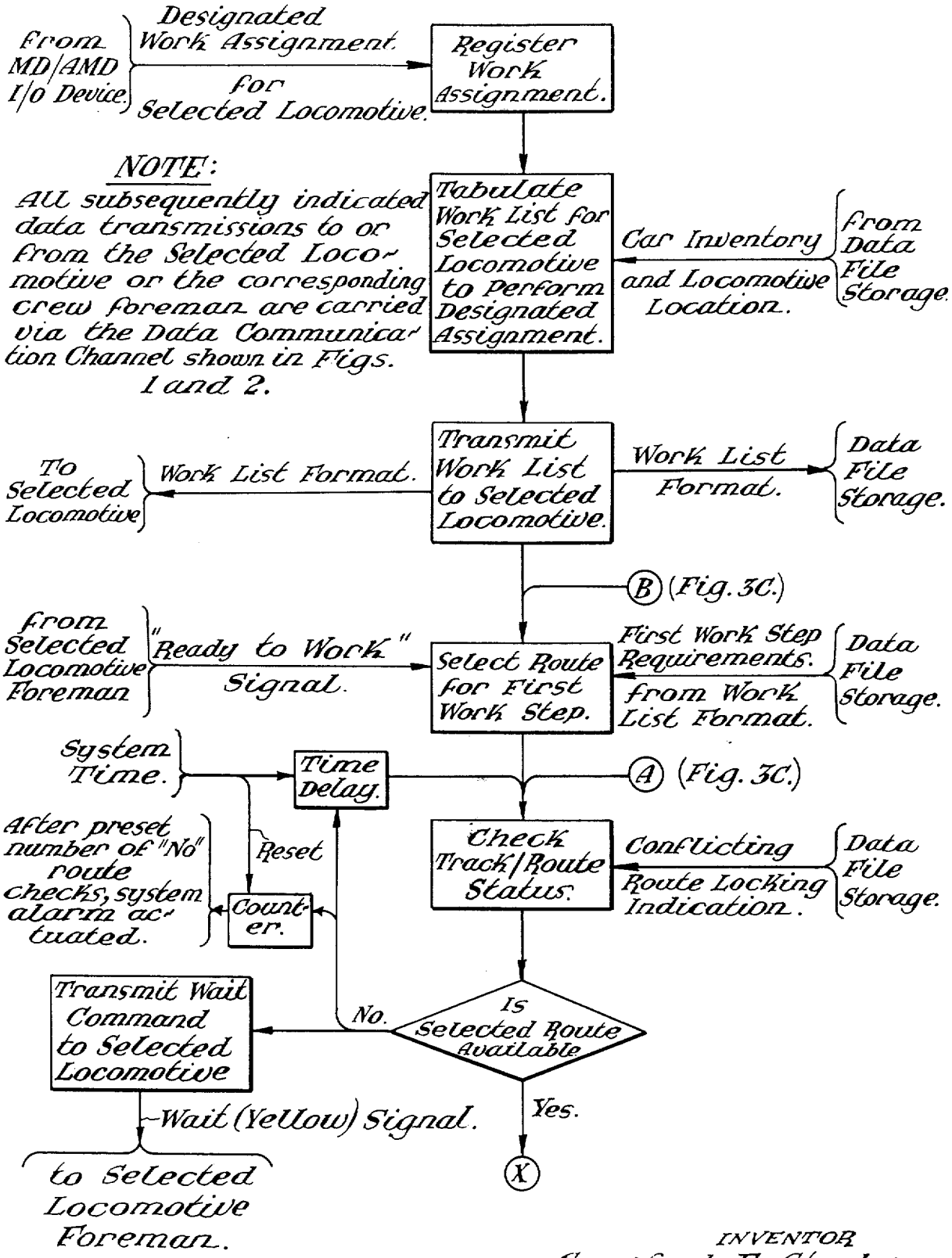
Figure 3B:
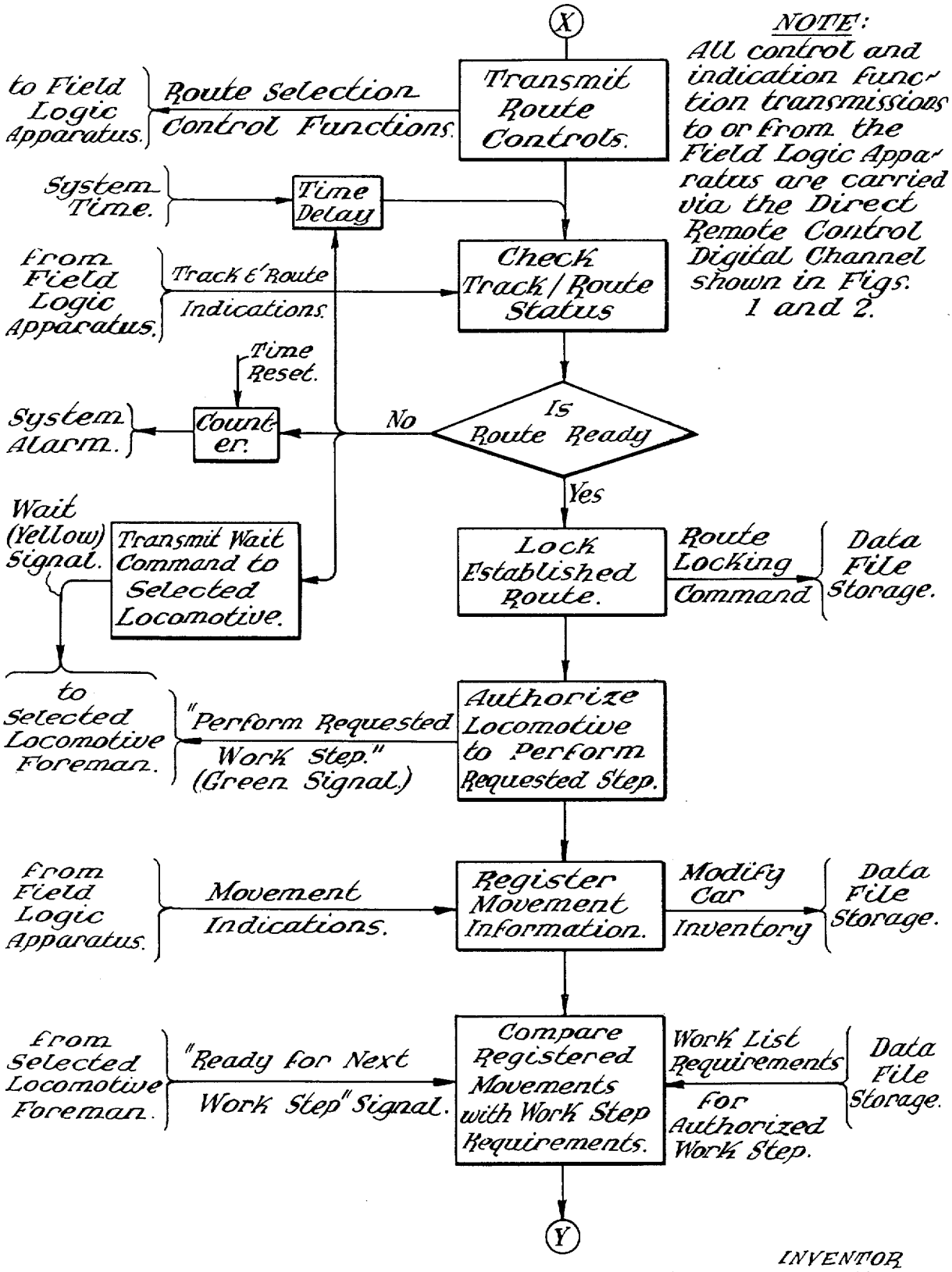
Figure 3C:
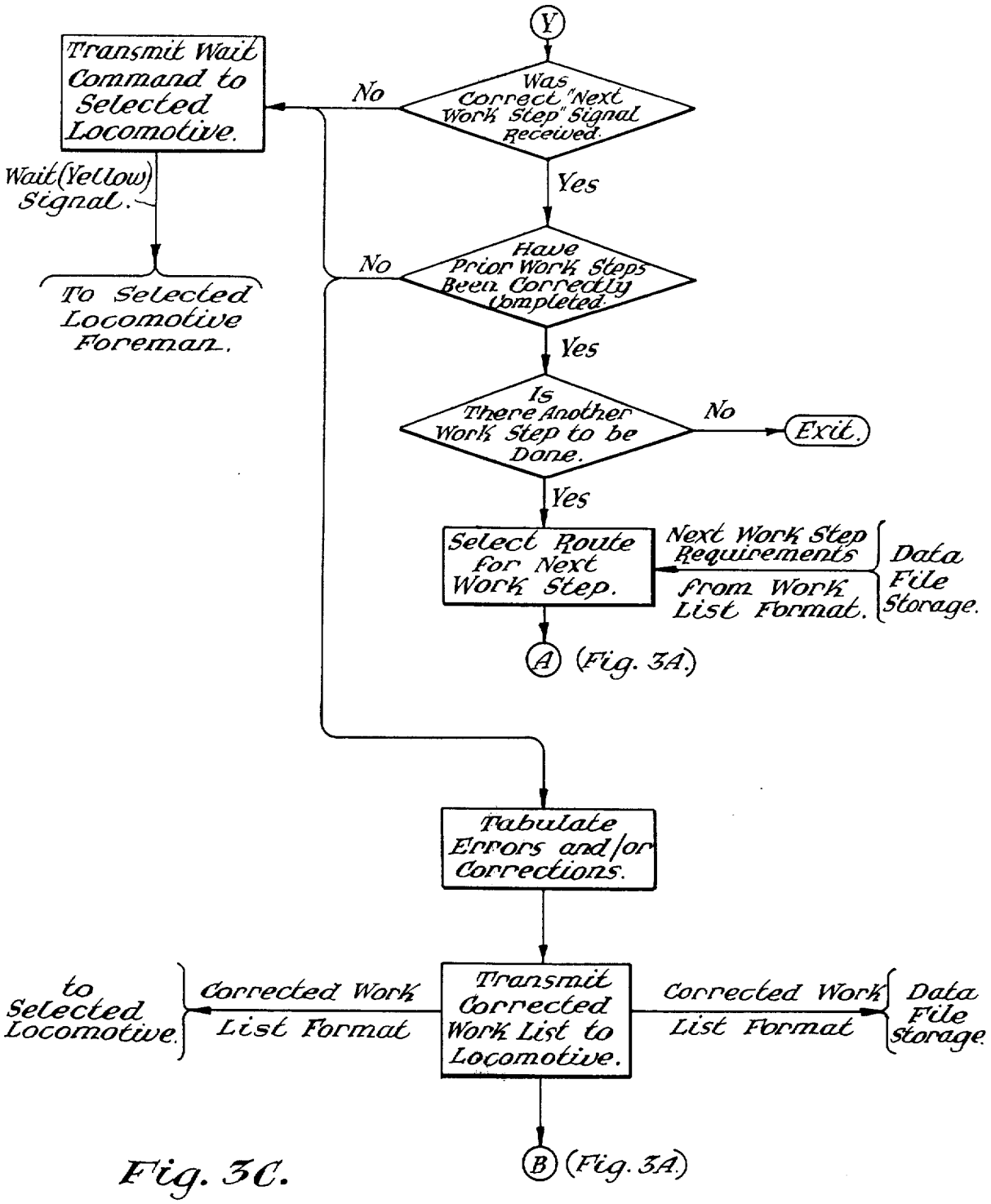

FIGS. 3A to 3C, when placed adjacent vertically in order, are a macro flow chart for the vehicle movement control process provided by my invention.

In each figure of the drawings, as appropriate, similar reference characters designate similar parts or portions of the apparatus and/or systems.

DESCRIPTION OF THE ILLUSTRATED EMBODIMENT

Figure 1:
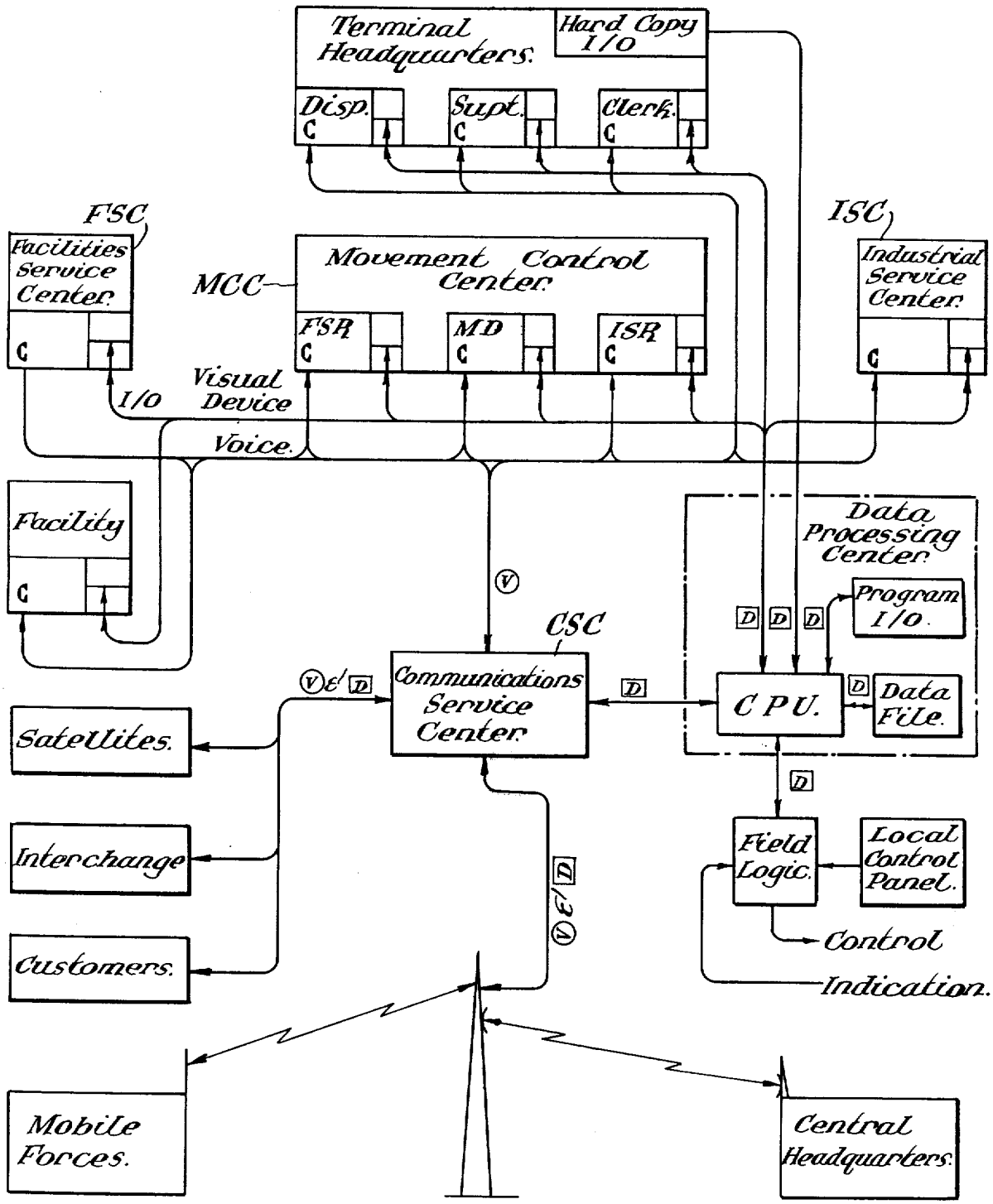
FIG. 1 is a diagrammatic illustration, in conventional block form, of a type of railroad terminal control system which may embody this invention.

I shall refer first to FIG. 1, which shows the overall system for controlling the operations of a large railroad terminal area. A conventional block at the top of this drawing figure represents, as is marked, the terminal headquarters. This is one of five major personnel groups or control locations within the terminal control system. The other four major locations, each outlined by a conventional block, comprise the Movement Control Center (MCC) shown below the terminal headquarters, the Facilities Service Center (FSC) and the Industrial Service Center (ISC) shown to the left and right, respectively, of the MCC location, and the Communication Service Center (CSC) shown below the Movement Control Center.

Another important element of the terminal control system is the data processing means, elements of which are grouped to the right of the Communication Service Center within a conventional dot-dash block designated as the Data Processing Center. These elements comprise a central data processing unit, labeled and hereafter referred to as the CPU, together with an associated program input/output (I/O) device and a data file or storage unit, all shown by conventional blocks. The central data processing unit CPU consists of the digital computer element which was previously mentioned as controlling the automatic switching and the speed control systems used in the classification yard to control the proper routing and correct coupling speed for classifying cars. During classification operations, data concerning car locations, i.e., inventory and car identification, both as to serial numbers and car parameters, is produced, correlated, and entered by the CPU into the Data File element, which represents the data storage capability of the data processing center. Such stored data may be recalled as needed in other operational procedures of the CPU. It is also to be noted that a single data processing center normally services the entire terminal system for management and supervisory control procedures. This includes, as already indicated, such data processing and computer procedures as needed for classification yard operations, for which priority interrupt type of input/output for data and controls is used. The CPU is further defined as any known type of on-line, real-time process control, stored program digital computer. One specific digital computer apparatus which has been used in such classification yard control systems, and which can also be used in the system here described, is the Honeywell Type DDP 516 which is manufactured by Honeywell Information Systems, Inc., Framingham, Mass. Normally, a basic machine language such as DAP-16 is used for programming.

Within the terminal headquarters block, the smaller blocks shown along the bottom represent the control console positions of the principal supervisory personnel located in that office. The center position is that of the terminal superintendent, designated SUPT, while to the left is the control position occupied by the main line train dispatcher (DISP) and to the right is the position occupied by the chief clerk and his assistants and designated as the CLERK position. Each control console position shown within the terminal headquarters is provided with access to the voice channels of the terminal communication system in order that such communication may be available with all parts of the terminal system and to various remotely located offices and other headquarters. This voice channel access is indicated at the left of each control console block by an appropriate symbol which is associated with the single line representation of the voice communications arrangement. This single line representation of the voice channels is designated throughout the drawings by an associated small circle with a letter V insert. Each control console position is also supplied with an input/output (I/O) or output only visual device which is used for a readout display of information essential to the operations controlled or supervised by that set of management personnel or for the input of control functions or command directives relative to that level of supervision. While any type of input/output display means appropriate to the operation may be used, a well-known type is the cathode ray tube (CRT) display device, with associated input keyboards, which can be used for the display of requested data or operational information and for the input of commands and other data. A specific CRT system which may be used, and which is compatible with the previously cited Honeywell computer, is manufactured by Computer Communications, Inc. All such data for display or for input is transmitted to and from the CPU in the Data Processing Center over digital communication links which are shown in the drawing by a single line representation further designated by a small square with the letter D insert. These input/output display devices are capable of providing a readout of the existing conditions throughout the terminal or of stored information and directions being given by other personnel, while the input may consist of desired actions, orders, or information for data storage. In some cases a hard copy record is essential for long reports and messages. For this purpose, a line printer may be required at the terminal headquarters in addition to input/output typewriters at some other locations. The terminal headquarters device for this purpose is designated by the smaller conventional block in the upper right of the terminal headquarters block. Such devices are also under the direct control of the CPU by direct digital link channels over which is transmitted the necessary information to provide such hard copy.

The Communication Service Center functions to provide communication channels between all elements of the terminal system and to various other headquarters and external locations. Switching is provided, normally automatically, for common user circuits for the transmission of digital data and voice communications. As required, this center also supplies recording, editing, and retransmission of messages and other types of recorded data. The communication service, as indicated, is not limited to the terminal area but will include channels or message service to customers, to interchange railroads, to satellite locations, and to the central operations headquarters of the entire railroad, designated by the block in the lower right. This external service in particular may be provided by various types of channels, such as wire telephone or teletype and both voice and high speed digital data transmission radio, including microwave channels. Of particular interest in the present discussion are the voice channels and digital data links established between the MCC and the CPU, respectively, and the mobile work forces employed throughout the terminal area, such as switching locomotives, repair crews, and other field service elements, all designated by the conventional block in the lower left of the drawing.

The Facilities Service Center is responsible for car and motive power servicing and repairs, for maintenance and servicing of all terminal facilities, and for similar functions. Communications, both digital and voice, are required for this center to various repair and maintenance crews, service shops, and similar locations. This FSC is provided with a control console which includes voice communication means and an input/output display device with digital link to the CPU. The Industrial Service Center is responsible for customer contacts and facilities and for initiating the pickup from, and delivery of cars to, industry tracks. The ISC also maintains an inventory of cars in industrial sidings within the terminal area jurisdiction. Obviously, this center also needs voice and digital communication to many places and is provided with a control console having a voice communication means and an input/output display device. Both of these service centers have representatives at the movement control center who also are provided with control consoles designated here by the left and right console symbols within the movement control center block, designated FSR and ISR, respectively. These representatives provide coordination between the service centers and immediate contact with the movement director for exceptional operations.

The movement control center also includes the movement director and such assistants as are necessary. A single control position is shown in this figure with the console symbol designated by the reference MD. Each element in the movement control center, including the FSR and ISR, is provided with communication means with access to the entire communication system, designated by the symbols showing the voice channel communication means and by the input/output display devices with digital links to the CPU. All of the input/output display devices will be of the same type throughout a particular system such as the cathode ray tube type previously mentioned. In the facilities and industrial service centers, the MCC, and the terminal headquarters, the digital communication links terminating in the input/output display devices provide direct access only into the CPU for input and readout of data. Data transmission to external locations and to terminal mobile work units is direct from the CPU over common user digital links switched by the CSC. Direct voice communication between the centralized locations such as the FSC, ISC, MCC, and the terminal headquarters is normally by intercommunication channels providing a direct link between such elements not requiring switching at the communication service center. However, the voice communication means on each control console also provide common user access through the communication center to locations external to the yard and to the mobile work units.

The final conventional block representing one of the centralized terminal control locations, that is, those blocks shown above the communication service center is that designated as FACILITY. This block represents all service and maintenance locations or shops handling such things as motive power, cars, cabooses, and track and wayside apparatus maintenance. It is to be noted that it is tied into the direct voice channels including the intercommunication arrangement for the centralized elements and is also tied into the digital link channels for direct access to the CPU from its input/output display device.

Figure 2:
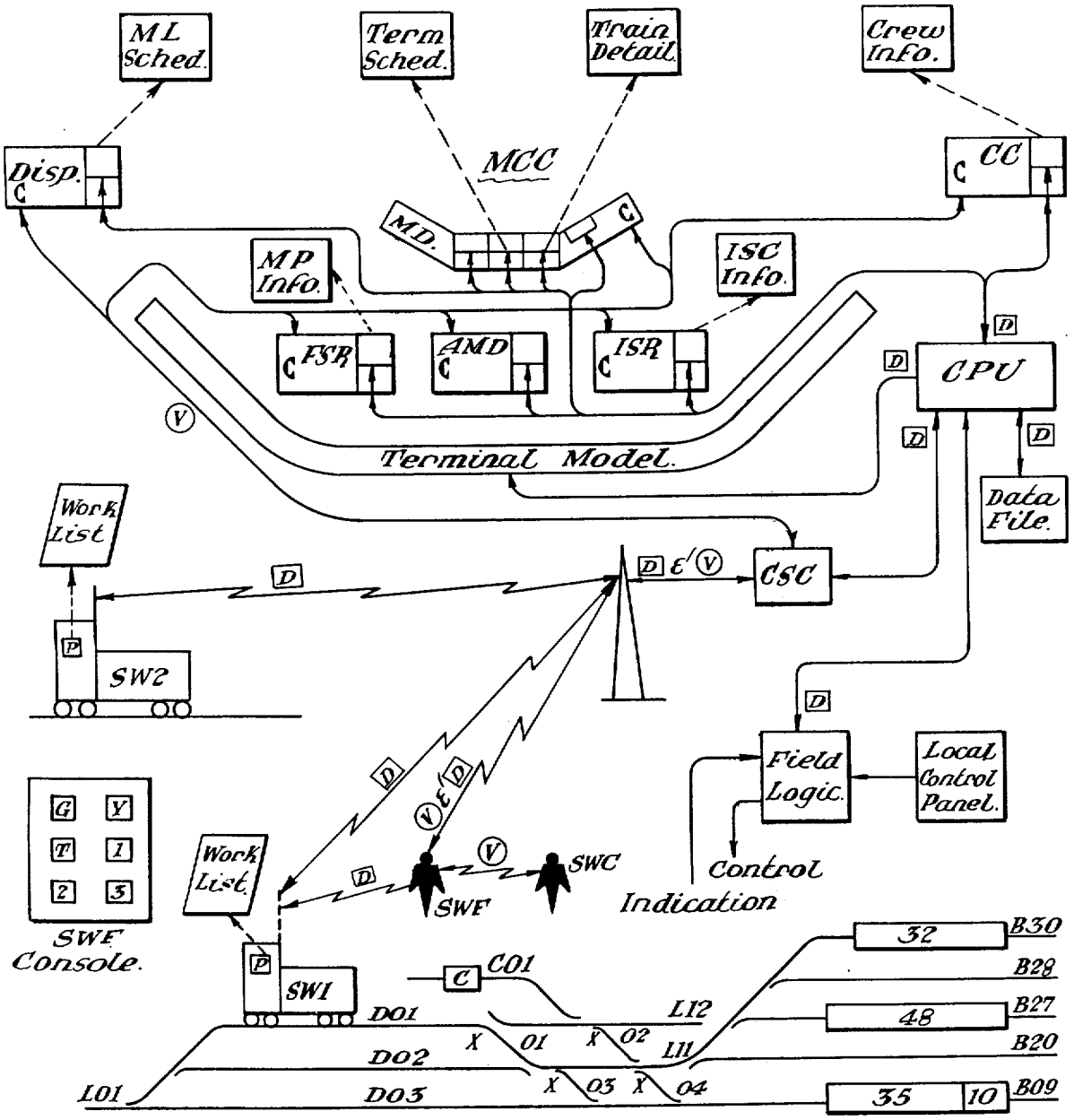
FIG. 2 is a partially diagrammatic, partially schematic illustration of a vehicle movement control arrangement embodying my invention as applied to a specific yard portion of the terminal control system illustrated in FIG. 1.

Since my invention is directed to the control of vehicle movements within the terminal area, a specific example of this type of control has been extracted from the overall system shown in FIG. 1 and is illustrated in FIG. 2, to which I now refer. At the top in this figure is shown diagrammatically an expanded movement control center MCC with two directly related operating facilities. An operating position or control console is illustrated for the movement director (MD), the facilities service representative (FSR), the industrial service representative (ISR), and one assistant movement director (AMD). The MD console is a master unit and is here shown with three input/output display devices. Typical information displays which may be entered into some of the devices are shown by the conventional blocks connected by dotted lines and consist of such items as the terminal schedule and individual train details. This console may have other devices for access to information readout in other forms. Smaller control consoles are indicated for the FSR, AMD, and ISR, each with a single input/output display device. Typical information which may be displayed on the FSR device is that pertaining to motive power availability, as conventionally indicated, while the ISR display device will normally show information concerning the industrial service center activity such as industry requests or car locations. The display device for the assistant movement director AMD will display items similar to those on the master MD console but at any one time will display that data associated with the specific duty to which the assistant is assigned. Each of these control console positions is, of course, provided with voice communication means, with access both to the intercommunication arrangement and to external communication facilities.

A large display model of the entire terminal area is illustrated as being located within the movement control center for display of general information and indications for an overall picture of the terminal operations. This model receives information only for display purposes, that is, readout only, as there is no associated input device. The specific details, of course, of the overall display illustration are extracted to the individual console display devices as the personnel handle particular problems occurring during terminal operations. As examples, two of the facilities associated with the operations of, but not in the same office location as, the MCC are shown, the mainline dispatcher (DISP) and the crew calling center (CC). Each has an operating console and the necessary communication facilities, both digital and voice. Typical information displays received from the CPU are indicated, i.e., the mainline dispatcher device displaying necessary mainline scheduling and that of the crew caller, the available crew information. The mainline dispatcher also has other control means and communications, for controlling the movement of trains on the mainline, which are not shown as they do not enter into the terminal operations here considered.

Also shown by conventional blocks are the central processing unit CPU and the communication service center CSC. Each serves the same purpose as that described for FIG. 1 but the communication links here shown are limited to those associated with the vehicle movement control arrangement. At the right, the CPU is shown with direct digital input and output links with the consoles of the various elements of the movement control center and directly related locations. The communication service center CSC provides common user type voice and digital data communication facilities between the movement control center and the CPU, respectively, and mobile work units involved in the yard or terminal operations. However, a separate direct digital transmission system is provided to the field logic units for remote control of track apparatus, such as track switches, and for the reception of indications from such wayside apparatus as car or wheel counters, train detectors, switch position indicators, and similar elements. Such remote control systems are well known and specific details are not necessary. Depending upon the desired transmission rate, the remote control system may be either a Time Code Control System (e.g., Type L, Form 514) or a Solid State Code Control System (e.g., Type 560) manufactured by the Union Switch & Signal Division, Westinghouse Air Brake Company, Swissvale, Pa., applicant's assignee. It may be noted that a local control panel is also provided with direct connections to the field logic units so that individual wayside control of such items as track switches may be exercised when necessary for purposes of exceptional type operations.

The lower part of FIG. 2 schematically illustrates portions of two yards of the terminal system and two switching locomotives working in various parts of the terminal. At the lower right are shown the remote ends, that is, distant from the hump, of a few of the bowl or storage tracks of the classification yard, each designated for reference purposes by a track number prefixed by the symbol B. The blocks shown on three of these tracks represent stored cars, the number of cars being that indicated by the number within the block. At the lower left are shown three tracks of the departure yard, designated in a conventional manner by the letter D preceding a two-digit number, such as track DO1 on which the switching locomotive is shown. Various lead tracks used for switching purposes are shown, designated by the letter L and a two-digit number, and a single caboose storage track CO1. Various switches and crossovers for establishing routes throughout the track network are illustrated, the crossovers being designated by an X and by a two-digit number reference. As previously mentioned, these switches and crossovers are controlled by the CPU through a direct digital communication system which provides for a remote control arrangement of all switches and interlocking arrangements within the yard. Also previously mentioned was the fact that indications of the switch positions and train occupancy of various detector track sections are returned by the same communication system to the CPU.

The switching locomotive SWl is illustrated sybolically as occupying or located on track DO1. Its crew is shown also by conventional symbols, the switching foreman SWF and the other crew members by the single symbol SWC. A second switching locomotive SW2 is illustrated as being elsewhere in the terminal area. For example, it may be working in the humping area, serving various industry tracks, or in the receiving yard. It may, of course, be also working in the departure yard area assembling outgoing trains. Each such locomotive within the terminal area is equipped with a data receiver and printout device, shown by the conventional block P within each SW symbol, connected by a digital communication link with the CPU. Such communication, of course, requires a radio channel since these are mobile units and obviously can not be connected by a fixed arrangement. Any one of several commercially available receiver-printer devices which is compatible with the specific digital communication channel provided may be used. One such device usable for this purpose is the radioteleprinter manufactured by Kleinschmidt Division of SCM Corporation, Deerfield, Illinois. The digital receiver and recording device provides printed work assignments and other instructions for the switching locomotive crew, illustrated by the WORK LIST block associated with each printer P.

The crew for each locomotive is interconnected by a voice communication channel, obviously short range radio. The switching foreman SWF is also linked by a voice channel with the movement control center and by a digital two-way communication link with the CPU. Each of these is part of the common user network switched through the CSC. A typical control console available to, or preferably carried by the foreman SWF is shown at the left for illustration purposes. This console contains a green and a yellow indication light, indicated as G and Y, respectively, an acknowledging pushbutton designated T, and three function transmission buttons 1, 2, and 3 for signaling the CPU that various elements of a work list, to be discussed shortly, have been completed. The operation of any one of these function pushbuttons on the foreman's console initiates the transmission over the digital communication link of the corresponding message to the CPU. The message is also identified as to its origin or transmitter location, for example, as coming from the crew of switching locomotive SW1. Also shown is a digital link between switching foreman SWF anad switching locomotive SW1. This is a remote locomotive control system by which the locomotive movements may be controlled by the foreman from any position off the locomotive or even when on the locomotive, if so desired. Such a system functions without any manual control operations on the locomotive and may be any typical system of this type. One example is shown in U.S. Pat. No. 3,096,056, issued July 2, 1963 to L. R. Allison for a Locomotive Remote Control System. It should be noted that this remote control of the locomotive is not effected through the SWF console shown. Rather, other control apparatus, not shown, is provided for this separate and distinct control system.

Before describing the operation of the vehicle movement control system, I shall briefly discuss the chart shown in FIGS. 3A to 3C. When FIGS. 3A, 3B, and 3C, in order, are placed adjacent in vertical column, with FIG. 3A at the top, a macro flow chart of the vehicle movement control process is formed, the links between the adjacent figures being designated by the circled letters X and Y. Conventional symbols are used and the other circled letters A and B designate points of entry or departure for repeat actions. This macro flow chart is illustrated in very general terms since, as mentioned, various models of digital computers are usable in the terminal control system. The illustrated chart does not provide the instructions from which more detailed flow charts may be developed in accordance with the specific computer being used in any one installation.

A typical movement control action using the apparatus illustrated in FIG. 2 will now be described, with reference also to the macro flow chart of FIGS. 3A to 3C. The assumption is that a new shift has come on duty in the movement control center to continue the usual 24 hour operation. In addition to the briefing given to each individual reporting for duty by the outgoing corresponding individual, observation of the terminal model will show the movement director the general status of the terminal area, location of the switching locomotives and approaching trains, and any potential trouble spots. A visual display readout of the current terminal schedule will enable him to plan overall movements for his shift and even for part of the next shift and to determine which must be done immediately. A visual display of train details is also available to enable him to initiate action, as will be discussed. If necessary, he may obtain additional visual information or talk with other personnel or facilities. Whenever the movement director MD initiates any action, the CPU will inform the mainline dispatcher (DISP) of any effect on the mainline scheduling, the crew clerk (CC) when and what crews are to be called, the facilities service representative (FSR) of motive power needs and other items, the industrial service representative (ISR) of effects on industrial requirements or plans, and finally the selected switching locomotive of the work assignment by a work list printout in a manner to be described. Conversely, each of these individuals or units is responsible for inputting information pertaining to their assignments to keep the CPU data file current and for informing the movement director of exceptional conditions.

It is assumed that the oncoming movement director now requests a terminal schedule display. At his input request, this display appears on one of his display devices, as conventionally illustrated, by digital transmission from the CPU, and will take the form shown by the partial example of such a schedule in the following chart.

TERMINAL SCHEDULE

| TRAIN | ARR | DEP | MU | MIX | TRK | EXCEPTIONS |
|---|---|---|---|---|---|---|
| NCP | 0715 | — | — | P | A13 | READY TO HUMP |
| MT | | 0810 | REDY | ME | LO3 | |
| DT | | 0905 | DEP | ME | LO5 | |
| 1NP | | 1100 | 0800 | ALL | | |
| UPD | | NS | 0800 | PME | | 82 IN 75 ADV |
| ID | | 1100 | 0900 | ME | | |
| 377 | 1300 | 1320 | 1000 | TFC | | |
| 378 | 1455 | 1510 | 1000 | TFC | | CUT OUT 32 HEAD |

The terminal schedule when visibly displaced shows the movement director the scheduled arrival, departure, and makeup times for trains, and the type loads (MIX), track assignment, and exceptions, in order of the earliest time involved. It may be noted that, for convenience, the 24-hour clock method of showing time is employed. The make-up time is determined by the CPU program in accordance with cut-off time for cars and estimated switching times. For non-scheduled (NS) trains, the make-up time may be established when the associated bowl tracks of the class yard become full or enough cars to make up the train are otherwise available, as in the illustrated example for train UPD. The movement director, of course, can change the make-up time as necessary to suit his overall plans. In the illustrated example, train MT is ready for departure and train DT is in departure status. These trains thus require no action by the oncoming movement director. However, from the terminal schedule and other available information, this movement director can plan ahead to determine whether or not additional switch locomotive crews, inspectors, and other personnel may be needed. He can see that trains 1NP and UPD will require immediate action in view of their programmed make-up times. He will thus visually display on one of his devices their train details.

Upon the request of the movement director, initiated on the input panel on one of his display devices, the CPU will furnish over the digital link the details for outgoing train 1NP as shown in the following chart.

TRAIN DETAILS

| TRAIN | DEP | MIX | TAG | TRK | Q | L | W | MU |
|---|---|---|---|---|---|---|---|---|
| 1NP | 1100 | ALL | 300 | B3O | 32 | 1612 | 1823 | P32 |
| | | | | A13 | 12 | 722 | 480 | |
| | | | | RIP | 2 | 105 | 74 | |
| | | | | 378 | 12 | | | |
| | | | | DT | 5 | | | |
| | | | 270 | B27 | 48 | 2416 | 3018 | P48 |
| | | | | A13 | 16 | 810 | 640 | |
| | | | | 378 | 14 | | | |
| | | | | DT | 4 | | | |
| | | | 090 | B09 | 35 | 1750 | 1763 | P35 |
| | | | | B09 | 10 | 510 | 612 | |
| | | | | A13 | 12 | 620 | 630 | |
| | | | | 378 | 6 | | | |
| | TOTAL MAKEUP 4-UNIT | | | | | 5778 | 6604 | 115 (DO2) |

The train detail display for departing trains will show the departure time, the MIX, and the block code or TAG for cars to be included in that particular train. The number (Q) and total length and weight of cars of the various selected block tags in each track or inbound train within the terminal area is also indicated. Make-up information for the train is developed by the CPU as shown in the final column of the train detail display. Train 1NP scheduled to depart at 1100 hours carries all types of traffic, blocked in the order of tags 300 and 270, with the train to be filled to 115 cars with cars of tag 090 on the rear. As previously indicated in the terminal schedule, there is a cut-off time for this train of 0800 hours. Since there are already enough cars as shown in the train detail display in the bowl tracks of the classification yard to assemble this train, the CPU program supplies the make-up plan to pull in succession 32 cars from bowl track B30, 48 cars from bowl track B27, and 35 cars from track B09, which will empty tracks B30 and B27 but leave 10 cars of tag 090 in track B09. The CPU program also totals the number, length, and weight of the cars to be used and specifies the number of locomotive units which will be required. This programming takes into account any restrictions on length or weight of cars or other factors which enter into the composition of the train. If the movement director agrees with the recommended make-up plan, he simply adds a departure track assignment D02, shown in parentheses in the last line of the chart, and presses the transmit button on his display device input panel which initiates the make-up actions. Alternate actions are available to the movement director in this case. For example, he might decide to increase the number of TAG 300 and TAG 270 cars by humping the cars already in receiving track A13 and eliminating or taking fewer cars of TAG 90 on the rear of the train. However, in the assumed example, the movement director has agreed with the proposed make-up plan and initiates the action by selecting a departure track as indicated in the last line of the train detail chart.

Although not specifically shown in the above illustrated details chart for train 1NP, the movement director or an assistant, knowing from the terminal model display the location of the various switching locomotives, will normally also designate the specific locomotive to perform the make-up of the train. Such selection of the switching locomotive as part of designating a work assignment is assumed in the initial input of the macro flow chart of FIG. 3A. It is specifically assumed that locomotive SW1 is selected to make up train 1NP.

Once the final decision on the make-up of the train is reached, in the specific example herein the selection of the departure yard track on which the train will be assembled and the locomotive to do the work, the CPU initiates the transmission of work commands, i.e., a work list format, to the selected switching locomotive to accomplish the train make-up assignment. This work list is transmitted over the digital communication link and is so addressed as to be received only by the selected locomotive, here switching locomotive SW1. Each locomotive has a data printout device P to receive and record in printed form the work list format, which is an item-by-item list of the sequential switching movements to accomplish the job assignment in the most economical and efficient manner. This work command sequence and the specific items thereon are developed by the CPU from the make-up program recommended and the other input programs and data storage available, including the known position of the switching locomotive selected. For the herein discussed assignment, i.e., the make-up of train 1NP, an example of the itemized work list as printed on locomotive SW1 follows.

```
56032-R22-J234
ADAMS-JELLICO
07/28 0800
MU-1NP
DO1
1 B30 X01
P32 SP562631
2 DO2
3 B27
P48 SP286035
1 B09 X03
P35 SP276025
2 DO2
S-ALL SP603125
TIE UP AT AIR
3 LO1
1 D01
2 L12
3 CO1
P1C-SP852
1 L11
2 D02
TIE ON C
3 L11
1 D01 X01
2 AWAIT ORDERS
```

Before considering the specific work list, it is to be noted that, within the terminal limits, the switching locomotive foreman is responsible for movement of the switching locomotive and any coupled cars. This foreman has a digital communication link with the CPU, as previously described, and voice communication specifically with the assistant movement director (AMD), with other movement control center personnel, and with other members of his switching crew. In general, the foreman takes the printed work list and when ready to make a specific movement, presses the corresponding numbered button on his console. The CPU checks that the previous moves were correctly made and then lines up the required route, if possible, and transmits a proceed command or authorizing signal which lights the green light G on the foreman's console, which he turns off by pushing the button T. The foreman then controls the switching locomotive to make the movement, preferably using the remote locomotive control system so that he may position himself to best observe the operation from a position off the locomotive. If an error had been made in executing the previous work item or the next route is tied up by other apparatus, the CPU transmits a hold or wait command which lights the yellow light Y in response to the foreman's indication of the completion of the preceding move, i.e., readiness for the next item. Under these conditions, if the error and correction instructions are not transmitted by the CPU or the route obstacle is not obvious, it may be necessary for SWF to talk to the AMD to correct the situation.

The illustrated work list for the switching operations to assemble train 1NP is a typical example of such work lists as printed on the switching locomotive for instruction to the crew. The work list shows, in the heading, the locomotive number, the radio number, and the job number, the crew, date and starting time, task description (fourth line, make-up train 1NP), and the present location of the locomotive. The rest of the work list format shows the movements to be made, in numbered sequences 1, 2, and 3, each including the next track destination, the specific route if there are alternates available, the number of cars to be pulled or set off, and the initials and serial number of the car where a cut is to be made. It is to be noted that the numbered sequence 1, 2, and 3 of the itemized movements or work operations repeats in cycles in order that a limited number of function transmission buttons may be used on the foreman's control console for transmitting the periodic reports to the CPU.

I shall now describe in somewhat more detail the centralized control of the operations of locomotive SW1 to complete the assumed job assignment of making up train 1NP on track DO2. The process may also be followed on the macro flow chart of FIGS. 3A, B, C. The immediately following action is shown at the fourth block level (from top) in FIG. 3A. The preceding description covers the portion of the chart above the present position. Foreman SWF, finding his crew ready, pushes function button No. 1 on his control console. This initiates the transmission of a ready-to-work (ready for item No. 1) signal to the CPU. The received signal is identified as coming from locomotive SW1 and the CPU, relating it to the previously assigned work list, checks the existing conditions in the work area as to occupancy by other locomotives or other possible obstacles. If all is clear, controls are transmitted over the separate digital channel to the field logic apparatus to establish a route from track DO1, where the locomotive is, to bowl track B30, taking into account the prescribed condition that the movement must utilize crossover X01 of the alternate routes available. When the route is established and the corresponding indications are received from the field logic, the CPU selectively transmits a signal to the SWF console to light the green light G. Foreman SWF, observing the green signal which he extinguishes by operating pushbutton T, controls the locomotive SW1 by his remote control system to move from its position on track D01 through crossover X01 and into track B30. The foreman also directs his crewman SWC to prepare for the pulling of 32 cars from bowl track B30 with the car bearing the serial number shown on the second line of item 1 on his work list as the most distant car. The crewman SWC checks the coupling of the various cars and possibly the air hose connections and if necessary uncouples any other cars in this bowl track beyond the 32 which are to be pulled at this time.

The foreman, with the locomotive in the bowl track prepared to pull the 32 cars, then presses the function button number 2 to transmit an indication of the completion of step No. 1 and readiness to follow with step No. 2 of the work list. The CPU makes the necessary check and transmits control functions to the field logic apparatus to line the route from track B30 to departure track D02 as directed by the work list. As locomotive SW1 backs out into track D02 pulling the cars from track B30, field detector devices will report to the CPU, by wheel count and/or other car detection information, the passage of the 32 cars along with the occupancy of the various switch detector sections. All this information is transmitted by the field logic apparatus over the direct remote control digital channel. The CPU checks the car movement indications against the inventory list previously prepared and other parameters stored as the cars were classified into that track to assure that all the cars intended are being removed from track B30. When the locomotive has completed the movement of pulling the cars, at least to clear the switch to track B27, foreman SWF presses his function button No. 3 to indicate readiness for the third item of the work list, that is, to enter bowl track B27.

The CPU checks the correct completion of item 2 prior to issuing the control functions to line the route into track B27. If too few cars or too many cars have been pulled from track B30, the detection of this error causes the CPU to transmit a signal to light the yellow lamp on the foreman's control console. This action is shown in the flow chart at the top of FIG. 3C. The normal process flow is further diverted (as shown in the chart), the errors and necessary corrections are tabulated, and a corrected work list format including these required corrections is transmitted to the locomotive, where it is received and recorded by the printer device P. Foreman SWF then controlss the locomotive and crew to make the movements directed by the corrected work list, which replaces or at least supplements the original list. Wait signals may also be caused if the next route is unavailable or is slow in being established, as shown in the flow chart in FIGS. 3A and 3B, respectively. If the reason for the yellow signal is not obvious, such as the next route occupied by another work unit, and a corrected work list is not shortly received, foreman SWF can communicate with the assistant movement director to determine what the exception is that causes a refusal of the next step. Of course, it may only be that the switch into track B27 is not cleared by the first block of cars, as the detector track means reports are received by the CPU from the field logic.

Assuming, however, that all is correct, the switch foreman's console green light G is illuminated, as soon as the track route is lined and locked, and the crew of locomotive SW1 continues with item 3. On the second line of item 3, the serial number of the most distant car of the 48 to be pulled is indicated so that the point at which the cut is made from any other cars in track B27 is known. When the 48 cars have been pulled from track B27, the existing string of 80 cars pulled into track D02, and the proper indications have been received by the CPU, transmission of the "ready for next work step" signal by operating button No. 1 of the foreman's console will actuate the CPU to issue directions to the field logic to line the route into track B09 over crossover X03, as is directed by the printed item 1 of the second cycle of the work list. The second line of work list item 1, second cycle, indicates the point at which the cut is to be made between the cars in track B09 since not all of the cars of tag 090 identity in this track are to be pulled during the make-up of this particular train.

When all the cars are pulled from the bowl tracks as directed by the work list, locomotive SW1 pulls into track D02 and all the cars are set out. The car number in the second line, item 2, second cycle of the work list designates the point at which the crew cuts off from the string of cars at the locomotive end, leaving that numbered car in track D02. In this example, all cars are left out and the car number is a check for the crew as to the lead car identity. The crew completes the preparation of the train unit to the extent required by their assigned duties. Having completed this item 2 of the second cycle of the work list, foreman SWF reports readiness to undertake the next work list item. The next three items require that locomotive SW1 will be operated out onto lead L01, back into departure track D01, and then onto lead L12. Each of these moves is made as the CPU causes the necessary route to be lined and transmits a green signal indication to the SWF control console to proceed with the next step. The last two moves, that is, items 1 and 2, third cycle, are separated so that other switching locomotives possibly working in the departure yard may also move along interfering routes, while switcher SW1 is traversing the necessary distances, in order that the work time in the yard of all switching locomotives may be used more efficiently. When work item 3, third cycle is authorized, locomotive SW1 moves into track C01 to pick up caboose No. SP852 as directed. This serial number of the caboose comes from the car inventory maintained by the CPU, which has thus determined that this is the first available caboose on this storage track. Locomotive SW1 is then operated through the fourth, three-item cycle of the work list to move onto track L11 annd back into track D02 to couple the caboose to the train and then to return into track L11.

Locomotive SW1 is then returned by the crew finally into track D01, its original position, to await further orders. Actually the next work assignment by this time may already have been transmitted from the CPU and printed out by the receiving device P on the locomotive. For example, while train 1NP was being made up, the movement director may have come to a decision as to the make-up of the next train in the terminal schedule, train UPD, and the necessary make-up program already decided and recorded in the CPU. This transmission of the next work assignment over the digital transmission channel direct to the printout device on the locomotive conserves time, allowing locomotive SW1 and its crew to remain on location and not have to return to a central point to receive the next order, nor long await the transmission of such work assignments.

During the assembly of a train, the work commands list of the necessary switching operations, such as illustrated previously, will include as necessary the setting out of any misrouted cars from the classification or bowl tracks as the blocks of cars are pulled to make up the train. This misrouting information is obtained by the CPU from the car tracking functions during humping operations and results in the recovery of such cars prior to the time that they might be inadvertently made up into a train for departure. The CPU, during the train make-up switching operations, also updates the car inventory storages for the various bowl tracks as the blocks of cars are pulled. Any up-to-date inventory is thus maintained as to cars in the classification yard which still are available to be made up into outgoing trains.

Other types of jobs, meanwhile, may be assigned to other mobile work units in the terminal area, for example, switching locomotive SW2. For such a work unit, the specific job may be the taking of cars from the industrial yard to set out on various industrial tracks serviced within the terminal area. The job list format under these conditions will include the car numbers and the industry track spotting positions at which they are to be located. It will also include the cars, by serial number, to be picked up and brought back to the yard for movement elsewhere and cars which are to be respotted along industry tracks in new positions. Locomotive SW2 may alternately be assigned to pushing a train over the hump into the classification yard. The work list will then designate the specific track number in the receiving yard from which the train is to be moved and will also designate the end cars of the block to be humped by their serial numbers. This humping movement will be controlled, similar to that described for locomotive SW1, by the CPU up to the time that the actual humping of the cars into the classification yard begins, that is, when the train is on the immediate approach to the hump location. From this point, the humping action is controlled directly and automatically over other control channels so as to obtain the optimum humping speed in accordance with the size of the cuts being released. This particular portion of the terminal area control system is not part of the present invention.

Following a humping operation, the humping locomotive crew may be directed to perform a trimming operation to correct any misroutes or to couple-up cars within a storage track which have stopped short of other cars. Misrouting occasionally occurs during classification because of the necessity of locking a particular track switch to prevent cornering of a car due to catch up by a following car. Also, due to unmeasurable variables, the speed control system does not always achieve coupling by every car classified. The operational method provided by this disclosure may also be used to direct and control this trimming operation. The track network is similar to that shown at the bottom of FIG. 2 and in fact is at the other end of the storage tracks such as B30, B28, etc. The control process for the trimming operation may be as complete as that previously described for the train make up. However, since the operation of the trimming locomotive is principally confined to move in and out of the storage tracks from a single lead track similar to track L11, certain modifications in the control process are possible without reducing the effectiveness of the operation.

The following description of a specific example of a modified control arrangement for a trimming operation is taken from the yard control system in use at the Alyth Yard of the Canadian Pacific Railroad, located at Calgary, Alberta, Canada. Upon completion of the humping of a particular train, the process control computer outputs a tabulation of misroutes which have occurred and the location of the misrouted cars. The terminal and yard controller (TYC), i.e., the operator, is informed also or has visual observation of those tracks in which cars have stopped short of preceding cars. In this specific installation, the TYC determines the necessary trimming actions and enters these into the computers as an itemized work list, using a CRT keyboard or a typewriter as an input device. In other words, he spells out the moves necessary for the trimming locomotive, i.e., the hump locomotive, to correct the misroutes and consolidate the cars in each track. This work list is printed out on selected other typewriters or output devices, and particularly at the hump crest to provide a copy to the trim locomotive crew. Further, the print out at other locations informs all concerned that the TYC has established or set up a trimming operation.

The trim locomotive crew proceeds to perform the work assignment, item by item. The computer outputs the necessary control functions, as and when required, to align switches to establish the trimming routes through the track network at the hump end of the storage tracks. The computer receives indications as to the moves made by the train locomotive, counts the cars moved, and compares the results of each move with the requirements of the corresponding item of the work assignment. The computer outputs the control functions to align the route for the next trimming step only if the movement just completed agrees with the required work. In this specific operation, there is no direct communication between the crew and the computer. The crew has a printed copy of the work list and, after performing a particular item, waits for the route required by the next step to be established. The computer also corrects the stored car inventory for each track from which misrouted cars aree removed or to which they are correctly added.

Computer program listings, in the DAP-16 language for the previously referenced Honeywell Type DPP 516 computer, to accomplish this trimming operation portion of the control process at Alyth Yard follow.

```
                 * PROGRAM NAME  -  TM
                 *
                 * CONFIGURATION:
                 *
                      EXD
                      REL
                      CF5
                 *                        TM---TRIM MOVE INTENDED.
                      EJCT
 0 04 00063      T100 STA    AREG        SAVE CONTENTS OF A-REGISTER.
                 *
 0 02 00131      T105 LDA    =117
-0 10 00111           JST*   BIT1        SET THE (TM) PROGRAM RUNNING BIT.
 0 000000             SAC    TRUN
                 *
 0 02 00063      T110 LDA    AREG
 100400               SPL                IS BIT 1 OF ENTRY CODE SET.
 0 01 00022           JMP    T140        YES
                 *
 0404 67         T115 LGR    9           NO
 0 03 00130           ANA    ='37
 0 04 00064           STA    DVNB        SAVE REQUESTOR'S DEVICE NO.
```

```
                *
-0 10 00112 T120 JST*  BITO    RESET THE DEVICE ACCESSABILITY BIT.
 0 000000        XAC   ACBT
                *
 0 02 00127 T125 LDA   =1
-0 04 00113      STA*  KTMV
 0 02 00126 T130 LDA   =60     FUNCTION COMPLETE INDICATION.
 0 35 00064      LDX   DVNB
-0 10 00114      JST*  MER1    QUEUE THE COMPLETE INDICATION.
                *
 0 01 00057      JMP   T210
 0 02 00125 T140 LDA   =2      BUFFER BUSY COUNT.
-0 10 00115      JST*  CK4     OBTAIN A 20 WORD SYSTEM BUFFER.
 0 01 00031      JMP   T145    NONE AVAILABLE --- RESCHEDULE.

 0 04 00050      STA   MBUF    SAVE BUFFER ADDRESS.
 0 04 00052      STA   MBF1
 0 04 00055      STA   MBF2
 0 01 00033      JMP   T150
                *
-0 10 00116 T145 JST*  B110    SCHEDULE EXEC TO RETURN TO
 0 000022        DAC   T140    THIS ADDRESS.
                *
-0 02 00117 T150 LDA*  KTWV    IS TW VARIABLE SET.
 0 07 00127      SUB   =1
 101040          SNZ
 0 01 00040      JMP   T155    YES
                *
 0 01 00045      JMP   T165    NO
 0 02 00124 T155 LDA   =A.     ASCII PERIOD AND ASCII BLANK.
 0 04 00100      STA   MSG+11  PREPARE TO MOVE TRUNCATED MESSAGE TO BUFFER.
                *
 0 02 00123 T160 LDA   =12     NO. OF WORDS TO MOVE
 140407          TCA
 0 04 00046      STA   T165+1  STORE PARAM. FOR SCAT SUBR.
                *
-0 10 00120 T165 JST*  SCAT    MOVE TM MESSAGE TO O/P BUFFER.
 177754          DEC   -20     NEG. OF NUMBER OF WORDS TO MOVE.
 0 000065        DAC   MSG     ADDR. OF MESSAGE.
 0 000000   MBUF DAC   **      ADDR. OF 20 WORD BUF. MSG. IS TO BE MOVED TO.
                *
-0 10 00121 T200 JST*  TOSL    QUEUE TM MESSAGE FOR OUTPUT TO TYC.
 0 000000   MBF1 DAC   **      ADDR. OF BUFFER.
 000010          DEC   8       TTY NO. OF TYC.
                *
-0 10 00121 T205 JST*  TOSL    QUEUE TM MESSAGE FOR OUTPUT TO CSC.
 0 000000   MBF2 DAC   **      ADDR. OF BUFFER.
 000020          DEC   16
                *
 0 02 00131 T210 LDA   =117
-0 10 00112      JST*  BITO    RESET THE (TM) PROGRAM RUNNING BIT.

 0 000000        XAC   TRUN
                *
-0 01 00122 T215 JMP*  B10B    RELEASE OVL-6 AND RETURN CONTROL TO EXEC.
                *
                *
                *
                *
                *
                *
                *    CONSTANTS, VARIABLES, TEMP STORAGE AND MESSAGES, XAC'S.
                *
 0 000000   AREC DAC   **      CONTENTS OF A-REG. ON ENTRY.
 0 000000   DVNB DAC   **      REQUESTOR'S DEVICE NO.
                *
                *
 152327     MSG  BCI   20, TW EXECUTION SUSPENDED AWAITING TW I/P.
 120305
 154305
 141725
 152311
 147716
 120323
 152723
 150305
 147304
```

```
142704
120301
153701
144724
144716
143640
152327
120311
127720
127240
            *
            *
            *
 0 000000   BIT1 XAC   BIT1
 0 000000   BIT0 XAC   BIT0
 0 000000   KTMV XAC   KTMV
 0 000000   MER1 XAC   MER1
 0 000000   CK4  XAC   CK4
 0 000000   B110 XAC   B110
 0 000000   KTWV XAC   KTWV
 0 000000   SCAT XAC   SCAT
 0 000000   TOSL XAC   TOSL
 0 000000   B10B XAC   B10B
            *
 000014          FIN
 127240
 000002
 000074
 000001
 000037
 000165
                 ORG   1777
 000325          DEC   213     TM
                 END

            * PROGRAM NAME  -  TW
            *
            * CONFIGURATION:
            *
                 EXD
                 REL
                 CF5
            *                     TW---TRIM WORK ASSIGNMENT.
                 EJCT
 0404 67    TKE  LGR   9
 0 03 00377      ANA   ='37
-0 04 00351 T100 STA*  ORDV    ORIGINATING DEVICE NO.
 0 04 00310      STA   DVNB
            *                   CHECK WHETHER REQUESTING DEVICE NO. IS 3, 4, 8 OR 9.
 0 11 00376      CAS   =3       THESE ARE THE ONLY LEGAL DEVICES THAT MAY REQUEST
 100000          SKP            EXECUTION.
 0 01 00021      JMP   T110     LEGAL DEVICE.
 0 11 00375      CAS   =4
 100000          SKP
 0 01 00021      JMP   T110     LEGAL DEVICE.
 0 11 00374      CAS   =8
 100000          SKP
 0 01 00021      JMP   T110     LEGAL DEVICE.
 0 11 00373      CAS   =9
 0 01 00266      JMP   ILDv     ILLEGAL DEVICE.
 0 01 00021      JMP   T110     LEGAL DEVICE.
 0 01 00266      JMP   ILDV     ILLEGAL DEVICE.
            *
 0 02 00372 T110 LDA   =118
-0 10 00331      JST*  BIT1     SET THE (TW) PROGRAM RUNNING BIT.
 0 000000        XAC   TRUN
            *
            *
 140040          CRA
-0 04 00334      STA*  ETGL
 0 02 00332      LDA   KPGA
 0 04 00102      STA   TWBA     STORE ADDRESS OF 1ST WORD OF MOVEMENT CODE.
            *
 0 10 00155 T115 JST   CONV     CONVERT AND EDIT THE 1ST TRIM MOVE.
 0 35 00312 T120 LDX   LNCT     COUNT OF NO. OF ITEMS STORED IN TTWA TABLE. (LOOP CT)
```

```
-1 04 00333        STA*  TTWA,1   INCREMENT COUNT OF NUMBER OF ITEMS STORED.
                *
-0 02 00334 T125   LDA*  ETGL     ESCAPE TOGGLE
 100040            SZE
 0 01 00136        JMP   T250     YES
 0 35 00102 T130   LDX   TWBA     NO. LOAD X-REG. WITH ADDRESS OF MOVEMENT CODE.
 1 02 00002        LDA   2,1      ORIG. BOWL TRK.
 141140            ICL
 0 04 00321        STA   TMPB
                *
 1 02 00002        LDA   2,1
 141050            CAL
 0 04 00322        STA   TMPB+1
                *
-0 10 00335 T135   JST*  AIBI     CONVERT ORIGINATING BOWL TRACK TO BINARY.
 0 000321          DAC   TMPB     ADDR. OF 1ST CHAR.
 0 000323          DAC   TMPB+2   ADDR. OF LAST CHAR. +1
 0 01 00252        JMP   T400     NON-NUMERIC ERROR RETURN.
                *
 101040            SNZ            TEST IF O.D. = HUMP LEAD.
 0 01 0016         JMP   T220     YES--NTUN & UNXL NOT REQUIRED.
-0 04 00346 T145   STA*  OBWL     SAVE ORIGINATING BOWL TRACK.
 0 07 00371        SUB   =49
 101400            SMI            CHECK IF ORIGINATING BOWL TRACK NO. IS LESS THAN 49
 0 01 00252        JMP   T400     NO IT ISN'T---ERROR CONDITION.
                *
 1 02 00003 T150   LDA   3,1      BB TRK IN LIMITS
 141050            CAL            NO. OF UNITS
 0 04 00321        STA   TMPB
-0 10 00335        JST*  AIBI     CONVERT NO. OF UNITS TO BINARY.
 0 000321          DAC   TMPB     ADDR. OF 1ST CHAR.
 0 000322          DAC   TMPB+1   ADDR. OF LAST CHAR+1.
 0 01 00254        JMP   T405     NON-NUMERIC ERROR RETURN.
                *
-0 04 00347 T155   STA*  NTUN     NO. OF TRIM UNITS. (BINARY)
 140407            TCA
 0 04 00311        STA   CCTR     COUNTER USED TO COUNT NO. OF AXLE COUNT CONVERSIONS.
 1 02 00004 T160   LDA   4,1      EAST OR WEST
 0 05 00370        ERA   =AWS
 101040            SNZ
 0 01 00101        JMP   T200     WEST
                *
-0 02 00347 T165   LDA*  NTUN     NUMBER OF UNITS.
 140500            SSM
-0 04 00347        STA*  NTUN
                *
-0 10 00326 T200   JST*  GTHW     CONVERT AXLE COUNT(S) TO BINARY.
 0 000000   TWBA   DAC   **
 000014            DEC   12
 0 04 00321        STA   TMPB
 0 12 00103        IRS   *-2
                *
-0 10 00335 T205   JST*  AIBI     FOUND SLASH. NOW CONVERT AXLE COUNT TO BINARY.
 0 000321          DAC   TMPB     ADDR. OF 1ST CHAR.
 0 000322          DAC   TMPB+1   ADDR. OF LAST CHAR.+1.
 0 01 00256        JMP   T410     NON-NUMERIC ERROR RETURN.
-0 04 00345        STA*  UNXL     STORE AXLE COUNT IN UNXL ARRAY.
 0 12 00345        IRS   UNXL     INCR. ADDR. AT WHICH NEXT CONVERSION TO BE STORED.
 0 12 00311        IRS   COTR     INCR. COUNTER WITH COUNT OF NUMBER OF UNITS.
 0 01 00101        JMP   T200     GO AND UNPACK NEXT AXLE COUNT.
                *
 0 02 00102 T220   LDA   TWBA     ADDR. OF STARTING LINE.
 0 06 00374        ADD   =8
 0 04 00102        STA   TWBA     ADDR. OF 2ND LINE.
                *
 0 10 00155 T225   JST   CONV     CONVERT AND EDIT NEXT TRIM MOVEMENT LINE.
 0 35 00312 T231   LDX   LNCT
-1 04 00333 T230   STA*  TTWA,1
 0 12 00312        IRS   LNCT
                *
-0 02 00334 T235   LDA*  ETGL     IS ESCAPE TOGGLE SET (I.E., IS ETOL = 1).
 0 11 00367        CAS   =1
 0 01 00131        JMP   T240     NC
 0 01 00136        JMP   T250     YES
                *
 0 02 00312 T240   LDA   LNCT     COUNT OF ITEMS IN TTWA TABLE.
 0 11 00366        CAS   =18      HAVE 18 LINES BEEN CONVERTED.
```

```
101000          NOP
0 01 00260      JMP   T415    YES
0 01 00121      JMP   T225    NO
          *
0 02 00367 T250 LDA   =1
-0 04 00336     STA*  KTWV    SET THE TW VARIABLE (KTWV = 1).
0 02 00312      LDA   LNCT    NO. OF ITEMS IN TTWA TABLE.
-0 04 00350     STA*  NTWA
          *
140040     T255 CRA
-0 04 00337     STA*  KTMV    CLEAR THE TM VARIABLE (KTMV = 0)
          *
0 02 00310      LDA   DVNB    DEVICE NO.
0 05 00365      ERA   ='140   SET ENTRY CODE = 3
0414 67         LGL   9       POSITION ENTRY CODE AT BITS 1-2
0 06 00364      ADD   =147    LOCATOR CODE FOR LMOM FUNCTION WHICH IS TO BE QUEUED.
-0 01 00327 T260 JMP* B12B    QUEUE LMON TO RUN NEXT.
          *
0 02 00372 T265 LDA   = 118
-0 10 00330     JST*  BIT0    RESET THE (TW) PROGRAM RUNNING BIT.
0 000000        XAC   TRUN
          *
-0 01 00340 T270 JMP* B10B    RELEASE OVL-B AND RETURN CONTROL TO EXEC.
          *
          *
          *
          *
          *
                EJCT
          *
          *
          *     CONV. SUBROUTINE---CONVERTS TRIM MOVEMENT LINE TO NUMERIC CODE
          *                        AND PACKS INFO INTO A-REG PRIOR TO EXIT.
          *
          *     CALLING SEQUENCE
          *                   LOCATION TWBA MUST CONTAIN ADDR. OF LOCATION CONTAINI
          *     JST   CONV    1ST MOVEMENT CODE CHAR. PRIOR TO CALLING CONV
          *
          *
          *
          *
0 000000  CONV DAC   **       SUBR. ENTRY POINT
          *
140040          CRA           INIT. CONV. SUBR. VAR.S
0 04 00307      STA   BLTK
0 04 00313      STA   MVCD
0 04 00314      STA   NCAR
          *
0 35 00102      LDX   TWBA    ADDR. OF MOVEMENT LINE.
1 02 00002 T300 LDA   2,1
0 04 00313      STA   MVCD    STORE 2 CHARS. OF MOVEMENT CODE.
0 35 00363      LDX   = -4
0 02 00313 T305 LDA   MVCD    MOVEMENT CODE.
1 07 00321      SUB   ASPL+1,1  SEARCH TABLE FOR MOVEMENT CODE.
101040          SNZ
0 01 00175      JMP   T130    WE'VE FOUND IT.
0 12 00000      IRS   0       INCREMENT X-REG.
0 01 00166      JMP   T305    CHECK AGAINST NEXT TABLE ENTRY.
0 01 00262      JMP   T240    MOVEMENT CODE NOT VALID. ERROR NO.
          *
0 02 00000 T310 LDA   0
0 06 00375      ADD   =4      GET NUMERIC MOVEMENT CODE
0 04 00313      STA   MVCD    AND SAVE IT.
          *
101040     T315 SNZ           ESCAPE MOVE (MVCD=0)
-0 12 00334     IRS*  ETGL    YES--SET ESCAPE TOGGLE (ETGL=1)
          *
0 35 00102 T325 LDX   TWBA    ADDR. OF MOVEMENT LINE.
1 02 00003      LDA   3,1     BOWL TRACK
141140          ICL
0 04 00321      STA   TMPB
1 02 00003      LDA   3,1
141050          CAL
0 04 00322      STA   TMPB+1
          *
```

```
-0 10 00335 T330 JST*  AIBI     CONVERT BOWL TRACK NO. TO BINARY.
 0 000321        DAC   TMPB     ADDR. OF 1ST CHAR.
 0 000323        DAC   TMPB+2   ADDR. OF LAST CHAR + 1
 0 01 00252      JMP   T400     NON-NUMERIC ERROR RETURN.
                 *
 0 07 00371 T335 SUB   =49      IS BOWL TRACK LT. 49
 101400          SMI
 0 01 00252      JMP   T400     NO
                 *
 0 06 00371 T340 ADD   =49      YES---SAVE THE BOWL TRACK.
 0 04 00307      STA   BLTK     STORE BOWL TRACK (BINARY).
                 *
-0 02 00334      LDA*  ETGL
 100040          SZE
 0 01 00240      JMP   T355     EXCAPE CODE--GET OUT.
                 *
 1 02 00012 T345 LDA   10,1     NUMBER OF CARS.
 141140          ICL
 0 04 00321      STA   TMPB
 1 02 00012      LDA   10,1
 141050          CAL
 0 04 00322      STA   TMPB+1
                 *
-0 10 00335 T350 JST*  AIBI     CONVERT NO. OF CARS TO BINARY.
 0 000321        DAC   TMPB     ADDR. OF 1ST CHAR.
 0 000323        DAC   TMPB+2
 0 01 00264      JMP   T425     NON-NUMERIC ERROR RETURN.
                 *
 0 04 00314      STA   NCAR     NO. OF CARS (BIN.).
                 *
 0 02 00102 T355 LDA   TWBA     BUMP THE ADDRESS TO ADDR.
 0 06 00362      ADD   =12      AT WHICH NEXT MOVEMENT CODE IS
 0 04 00102      STA   TWBA     AND SAVE ADDR.
                 *
 0 02 00307      LDA   BLTK     PACK MOVEMENT CODE, NO. OF CARS, BOWL TRACK INTO
 0400 72         LRL   6        A-REGISTER.
 0 02 00314      LDA   NCAR
 0400 70         LRL   8        SHIFT NO. OF CARS INTO B-REG.
 0 02 00313      LDA   MVCD
 0410 62         LLL   14       PACKED WORK TO BE STORED IN TTWA TABLE.
-0 01 00155      JMP*  CONV     RETURN TO CALLING PROGRAM.
                 *
                 *
 0 35 00361 T400 LDX   =295     ERROR NO. 295---ILLEGAL BOWL TRACK.
 0 01 00270      JMP   T430
                 *
 0 35 00360 T405 LDX   =296     ERROR NO. 296---ILLEGAL NUMBER OF UNITS.
 0 01 00270      JMP   T430
                 *
 0 35 00357 T410 LDX   =297     ERROR NO. 297---ILLEGAL UNIT AXLE COUNT.
 0 01 00270      JMP   T430
                 *
 0 35 00356 T415 LDX   =298     ERROR NO. 298---INCOMPLETE TW.
 0 01 00270      JMP   T430
                 *
 0 35 00355 T420 LDX   =299     ERROR NO. 299---ILLEGAL MOVEMENT CODE.
 0 01 00270      JMP   T430
                 *
 0 35 00354 T425 LDX   =300     ERROR NO. 300---ILLEGAL NO. OF CARS.
 0 01 00270      JMP   T430
                 *
 0 35 00353 ILDV LDX   =58      ERROR NO. 58---INVALID I/P DEVICE.
 0 01 00275      JMP   T440
 0 02 00352 T430 LDA   = -18    NEGATIVE OF NO. OF WORDS TO BE CLEARED.
-0 10 00341      JST*  U110     CLEAR THE TTWA TABLE.
 0 000000        XAC   TTWA     ADDR. OF TABLE.
                 *
 0 02 00367 T435 LDA   =1       RESTORE THE SYSTEM ESCAPE ROUTE.
-0 04 00333      STA*  TTWA     SET 1ST WORD OF TTWA TABLE TO 1.
                 *
 0 02 00000 T440 LDA   0        ERROR NUMBER.
 0 35 00310      LDX   DVNB
-0 10 00342      JST*  MER1     QUEUE THE ERROR CODE FOR OUTPUT.
                 *
 0 02 00310 T445 LDA   DVNB
-0 10 00330      JST*  DITO     RESET THE DEVICE ACCESSABILITY BIT.
 0 000000        XAC   ACBT
```

```
                *
140040          T447 CRA            CLEAR THE VM/TW/WA ACTIVE FLAG.
-0 04 00343          STA*   KPGM
-0 04 00344          STA*   KVM
 0 01 00131          JMP    T265
                *
                *    CONSTANTS, VARIABLES, TEMP STORAGE, XAC'S.
                *
                *
 0 000000       BLTK DAC    **       BOWL TRACK (BINARY).
 0 000000       DVNB DAC    **       REQUESTOR'S DEVICE NO.
 0 000000       CCTR DAC    **       COUNTER USED TO COUNT NO. OF AXLE COUNTS TO CONVERT.
 0 000000       LNCT DAC    **       COUNT OF NO. OF ITEMS STORED IN TTWA TABLE.
 0 000000       MVCD DAC    **       MOVEMENT CODE.
 0 000000       NCAR DAC    **       NUMBER OF CARS (BINARY).
 142730         ASEX OCT    142730   ASCII CODE FOR EX MOVEMENT CODE.
 151710         ASSH OCT    151710   ASCII CODE FOR SH MOVEMENT CODE.
 151717         ASSO OCT    151717   ASCII CODE FOR SO MOVEMENT CODE.
 150314         ASPL OCT    150314   ASCII CODE FOR PL MOVEMENT CODE.
                *
 000000         TMPB BSZ    5        TEMP STORAGE USED FOR UNPACKING CHARS. PRIOR TO CONV.
 000000
 000000
 000000
 000000
                *
                *
                *
 0 000000       GTHW XAC    GTHW
 0 000000       B12B XAC    B12B
 0 000000       BITO XAC    BITO
 0 000000       BITI XAC    BITI
 0 000000       KPGA XAC    KPGA
 0 000000       TTWA XAC    TTWA
 0 000000       ETGL XAC    ETGL
 0 000000       AIBI XAC    AIBI
 0 000000       KTWV XAC    KTWV
 0 000000       KTMV XAC    KTMV
 0 000000       B10B XAC    B10B
 0 000000       U110 XAC    U110
 0 000000       MER1 XAC    MER1
 0 000000       KPGM XAC    KPGM
 0 000000       KVM  XAC    KVM
 0 000000       UNXL XAC    UNXL
 0 000000       OBWL XAC    OBWL
 0 000000       NTUN XAC    NTUN
 0 000000       NTWA XAC    NTWA
 0 000000       ORDV XAC    ORDV
 177756              FIN
 000072
 000454
 000453
 000452
 000451
 000450
 000447
 000014
 177774
 000223
 000140
 000022
 000001
 153723
 000061
 000166
 000011
 000010
 000004
 000003
 000037
                     ORG    '777
 000323              DEC    211      TW
                     END
```

```
                 * PROGRAM NAME  -  XT
                 *
                 * CONFIGURATION:
                 *
                      EXD
                      REL
                      CF5
                 *
                      EJCT
                 *
 0 04 00116           STA    ENTA     SAVE ENTRY A REGISTER.
                 *105
 0 02 00110           LDA    PRB      SET PROG.
-0 10 00073           JST*   BIT1     RUN BIT.
 0 000000             XAC    TRUN
                 *110
 0 02 00116           LDA    ENTA     TEST IF ENTRY CODE.
 100400               SPL             BIT 1 IS SET.
 0 01 00021           JMP    L150     YES
                 *115
 0404 67              LGR    9        ISOLATE REQUESTOR'S.
 0 03 00115           ANA    ='37     INPUT DEVICE
 0 04 00117           STA    DVNO     NUMBER,
                 *120
-0 10 00072           JST*   BIT0     RESET DEVICE
 0 000000             XAC    ACBT     ACCESSIBILITY BIT.
                 *130
 0 02 00114           LDA    =1       SET FLAG
-0 04 00070           STA*   AA       FOR P/C
                 *140
 0 02 00113           LDA    =60      QUEUE COMPLETE CODE
 0 35 00117           LDX    DVNO     MESSAGE FOR
-0 10 00104           JST*   MER1     REQUESTOR'S DEVICE
                 *145
                 *
                      EJCT
                 *
-0 02 00070      L150 LDA*   AA       GET TERMINATION REASON.
                 *155
-0 10 00071           JST*   BINA     TO ASCII.
-0 000130             DAC*   OBUF+8   LAST WORD.
 177775               DEC    =3       NUMBER OF CHARACTERS.
                 *160
-0 10 00077           JST*   DTTM     DATE/TIME
 0 000131             DAC    OBUF+9   TO OUTPUT LINE
                 *
 0 02 00112      L165 LDA    =2       GET A FREE
-0 10 00076           JST*   CK4      20 WORD SYSTEM BUFFER
 0 01 00036           JMP    L170     NONE FREE
 0 04 00043           STA    BUF1     SAVE FOR SCAT
 0 04 00045           STA    A200     SAVE FOR TOSL
 0 04 00050           STA    A205     SAVE FOR TOSL
 0 01 00040           JMP    L200     AND CONTINUE
                 *
-0 10 00075      L170 JST*   B110     SCHEDULE EXECUTIVE
 0 000027             DAC    L165     RETURN
                 *
-0 10 00105      L200 JST*   SCAT     CORE TO CORE TRANSFER
 177754               DEC    =20      NUMBER OF WORDS
 0 000120             DAC    OBUF     FROM
 0 000000        BUF1 DAC    **       TO
                 *
-0 10 00106           JST*   TOSL     QUEUE SINGLE LINE MESSAGE
 0 000000        A200 DAC    **       BUFFER ADDRESS
 000010               DEC    8        TYC - TTY
                 *205
-0 10 00106           JST*   TOSL     QUEUE SINGLE LINE MESSAGE
 0 000000        A205 DAC    **       BUFFER ADDRESS
 000020               DEC    16
                 *210
 0 02 00111           LDA    = -18    NUMBER OF WORDS
 001001               INH             ZERO TTWA WITH INTERRUPTS OFF
-0 10 00107           JST*   U110     ZERO TTWA TABLE
```

```
 0 000000   TTWA XAC   TTWA     TABLE ADDRESS
            *215
 000401          ENB            RESTORE INTERRUPTS
            *
 140040     L220 CRA
-0 04 00102      STA*  KTMV     CLEAR TM
            *225
-0 04 00103      STA*  KTWV     ALSO TW
-0 04 00100      STA*  NTUN
-0 04 00101      STA*  NTWA
            *230
 0 02 00110      LDA   PRB      RESET PROGRAM
-0 10 00072      JST*  BIT0     RUN BIT
 0 000000        XAC   TRUN
            *
-0 01 00074      JMP*  B10A     AND EXIT
            *
                 EJCT           END OF CODE
            *
 0 000000   AA   XAC   KAAV
 0 000000   BINA XAC   BINA
 0 000000   BIT0 XAC   BIT0
 0 000000   BIT1 XAC   BIT1
 0 000000   B10A XAC   B10A
 0 000000   B110 XAC   B110
 0 000000   CK4  XAC   CK4
 0 000000   DTTM XAC   DTTM
 0 000000   NTUN XAC   NTUN
 0 000000   NTWA XAC   NTWA
 0 000000   KTMV XAC   KTMV
 0 000000   KTWV XAC   KTWV
 0 000000   MER1 XAC   MER1
 0 000000   SCAT XAC   SCAT
 0 000000   TOSL XAC   TOSL
 0 000000   0110 XAC   0110
            *
 000177     PRB  DEC   127      PROGRAM RUN BIT
            *
 177756          FIN
 000002
 000074
 000001
 000037
 000000     ENTA DEC   0        ENTRY A REGISTER
 000000     DVNO DEC   0        REQUESTOR'S DEVICE NUMBER
 152327     OBUF BCI   20,TW TERMINATED
 120324
 142722
 146711
 147301
 152305
 142240
 120240
 120240
 120240
 120240
 120240
 120240
 120240
 120240
 120240
 120240
 120240
 120240
 120240
 120240
                 ORG   '777
 000023          DEC   19
                 END

            * PROGRAM NAME  -  AMI1
            *
            * AMI1             AUTOMATIC MOVE INVENTORY PART (1) CORE-C
            *
                 SUBR  AMI1    CORE-C ENTRY POINT (ENTRY)
```

```
                    SUBR  XCCT     DATA FROM CAR CONTROL TABLES
                    SUBR  XTLS     TRACK LIST ITEM IMMAGE
              *
              *
              *
              *     AMI1           DETERMINE CAR, MOVE CCT TO XCCT, PUSH-UP CCT
              *
 01001        AMI1 INH             INHIBIT INTERRUPTS FOR DURATION OF AIM1
              *
-0 02 **            LDA*  AGND
 100040             SZE            TEST END OF HUMP
 0 01 **            NOP            YES--ABORT
 0 35 00143         LDX   OP       INITIATE SEARCH INDEX
 0 02 00000   AM01  LDA   0        TEST FOR ALL CAR CONTROL TABLE ENTRIES EXAMINED
-0 11 **            CAS*  NMX      NMX IS NUMBER OF ENTRIES
 101000             NOP
 0 01 **            JMP   AM09     YES--NO HITS--NO FURTHER ACTION NEEDED
              *
-1 02 **            LDA*  CTMX,1   TEST CALB BIT-1 FOR THIS CAR'S
 101400             SMI            CALIBRATION DATA HAS BEEN COLLECTED
 0 01 **            JMP   AM08     = 0 NO
              *
-1 02 **            LDA*  CTZN,1   GET ON CREST END ZONE OF THIS CAR   BITS 1-8
 141140             ICL
 0 11 **            CAS   =48      TEST FOR CAR NOW IN BOWL
 0 01 **            JMP   AM10     YES--A HIT
 0 01 **            JMP   AM10     YES--A HIT
              *                   NO
 0 12 00000   AM08  IRS   0        STEP SEARCH INDEX
 0 01 00274         JMP   AM01     TEST NEXT ENTRY
              *
              *
 140040       AM09  CRA            CLEAR
-0 04 **            STA*  KAMI     NEED FOR AMI CNTR FLAG
-0 04 **            STA*  BAMI     AMI FUNCTIONS TO PROCESS CNTR FLAG
              *
 000401             ENB            ENABLE INTERRUPTS
              *
-0 01 **            JMP*  B10C     FUNC COMPLETE RTN---FREE CORE-C
              *
                    EJCT
              *
              *     AM10           GET OLDEST CAR IN THIS ZONE AND SETUP INDEX-BASES
              *
-0 04 **      AM10  STA*  KX       SET ZONE PARAM
 0 02 00142         LDA   1N       FOR BOWL TO CREST SEARCH
-0 04 **            STA*  CTB      SET DIRECTION PARAMETER
-0 10 **            JST*  SEON     GET OLDEST CAR IN ZONE AND PLACE IN SQX
              *
 0 02 **      AM12  LDA   CTID     ADR OF CAR CONTROL TABLE
-0 06 **            ADD*  SQX      OLDEST CAR IN ZONE ENTRY VALUE RELV TO 1
 0 07 00123         SUB   1P       FOR INDEX ACCESSING
 0 04 00000         STA   0        SET INDEX-BASE FOR XCCT MOVE
 0 04 **            STA   AM1X     SET 1ST INDEX-BASE FOR PUSH-UP OF TABLES 1-17
 0 06 **            ADD   =510
 0 04 **            STA   AM2X     SET 2ND INDEX-BASE FOR PUSH-UP OF TABLES 18-19
              *
              *     AM20           MOVE CTT TABLES 1-12 CAR INFO INTO XCCT STORAGE
              *
 1 02 00000   AM20  LDA   0,1      CTID
 0 04 **      STA   XCCT
              *
 1 02 00036         LDA   30,1     CTOR
 0 04 **            STA   XCCT+1
              *
 1 02 00074         LDA   60,1     CTL1
 0 04 **            STA   XCCT+2
              *
 1 02 00132         LDA   90,1     CTL2
 0 04 **            STA   XCCT+3
              *
 1 02 00170         LDA   120,1    CTSN
 0 04 **            STA   XCCT+4
              *
 1 02 00226         LDA   150,1    CTCG
```

```
0 04 **          STA   XCCT+5
            *
1 02 00264       LDA   180,1    CTWT
0 04 **          STA   XCCT+6
            *
1 02 00322       LDA   210,1    CTT2
0 04 **          STA   XCCT+7
            *
1 02 00360       LDA   240,1    CTMX
0 04 **          STA   XCCT+8
            *
1 02 00416       LDA   270,1    CTTD
0 04 **          STA   XCCT+9
            *
1 02 00454       LDA   300,1    CTMG
0 04 **          STA   XCCT+10
            *
1 02 00512       LDA   330,1    CTC1
0 04 **          STA   XCCT+11
            *
                 EJCT
            *
            *    AM30  PUSH-UP CAR CONTROL TABLES AND CLEAR VACATED SLOTS
            *
-0 02 **    AM30 LDA*  SQX      CAR ENTRY VALUE RELV TO 1
-0 07 **         SUB*  NMX      NUMBER OF CARS IN TABLE
101040           SNZ            TEST IF LAST CAR WAS MOVED TO XCCT
0 01 **          JMP   AM40     YES--PUSH-UP NOT NECESSARY--CLEAR WORD IN TABLES
0 04 **          STA   AMCN     SET PUSH-UP CNTR
            *
            *
            *
0 35 **     AM32 LDX   AM1X     INDEX-BASE FOR PUSH-UP OF TABLES 1-17 (CTID-CTCQ)
1 02 00001       LDA   1,1
1 04 00000       STA   0,1
            *
1 02 00037       LDA   31,1
1 04 00036       STA   30,1
            *
1 02 00075       LDA   61,1
1 04 00074       STA   60,1
            *
1 02 00133       LDA   91,1
1 04 00132       STA   90,1
            *
1 02 00171       LDA   121,1
1 04 00170       STA   120,1
            *
1 02 00227       LDA   151,1
1 04 00226       STA   150,1
            *
1 02 00265       LDA   181,1
1 04 00264       STA   180,1
            *
1 02 00323       LDA   211,1
1 04 00322       STA   210,1
            *
1 02 00361       LDA   241,1
1 04 00360       STA   240,1
            *
1 02 00417       LDA   271,1
1 04 00416       STA   270,1
            *
1 02 00455       LDA   301,1
1 04 00454       STA   300,1
            *
1 02 00513       LDA   331,1
1 04 00512       STA   330,1
            *
1 02 00551       LDA   361,1
1 04 00550       STA   360,1
            *
1 02 00607       LDA   391,1
1 04 00606       STA   390,1
            *
```

```
1 02 00645        LDA   421,1
1 04 00644        STA   420,1
            *
1 02 00703        LDA   451,1
1 04 00702        STA   450,1
            *
1 02 00741        LDA   481,1
1 04 00740        STA   480,1
            *
            *
0 35 **     AM34  LDX   AM2X    INDEX BASE FOR PUSH-UP OF TABLES 18-19 (CTBO-CTTN)
            *
1 02 00001        LDA   1,1
1 04 00000        STA   0,1
            *
1 02 00037        LDA   31,1
1 04 00036        STA   30,1
            *
            *
0 12 **     AM36  IRS   AM1X    STEP 1ST INDEX-BASE
0 12 **           IRS   AM2X    STEP 2ND INDEX-BASE
            *
0 12 **           IRS   AMCN    STEP PUSH-UP CNTR
0 01 00367        JMP   AM32    ANOTHER ENTRY SLOT TO PUSH-UP
            *
            *
            *
140040      AM40  CRA           CLEAR VACATED SLOTS
0 35 **           LDX   AM1X    INDEX-BASE TO CLEAR SLOT IN TABLES 1-17 (CTID-CTCO)
            *
1 04 00000        STA   0,1
1 04 00036        STA   30,1
1 04 00074        STA   60,1
1 04 00132        STA   90,1
1 04 00170        STA   120,1
1 04 00226        STA   150,1
1 04 00264        STA   180,1
1 04 00322        STA   210,1
1 04 00360        STA   240,1
1 04 00416        STA   270,1
1 04 00454        STA   300,1
1 04 00512        STA   330,1
1 04 00550        STA   360,1
1 04 00606        STA   390,1
1 04 00644        STA   420,1
1 04 00702        STA   450,1
1 04 00740        STA   480,1
            *
0 35 **           LDX   AM2X    INDEX-BASE TO CLEAR SLOT IN TABLES 18-19 (CTBO-CTTN)
            *
1 04 00000        STA   0,1
1 04 00036        STA   30,1
            *
            *
            *
-0 02 **    AM44  LDA*  NMX
 0 07 00123       SUB   1P      REDUCE NUMBER OF ENTRIES IN CAR CONTROL TABLE
-0 04 **          STA*  NMX
            *
            *
-0 02 **    AM46  LDA*  KAMI
 0 07 00123       SUB   1P      DECREMENT NEED FOR AMI CNTR FLAG
-0 04 **          STA*  KAMI
            *
            *
            *
 000401           ENB           ENABLE INTERRUPTS
            *
 0 02 **          LDA   XCCT    GET THE TLST ITEM ID
 0 03 **          ANA   377M    CLEAR BITS 1-8
 0 11 **          CAS   370M    TEST FOR ENGINE
 0 01 **          JMP   AM50    YES
 0 01 **          JMP   AM50    YES
            *
```

```
 0 02 **     AM48 LDA   AM2L    AMI2 PAGE LOCATOR
-0 10 **          JST*  B13A    QUEUE AMI2 FUNC IN OVL-A
             *
 100040           SZE          WAS FUNCTION QUEUED
-0 01 **          JMP*  810C    YES--NORMAL COMPLETION RETURN
             *
 140040           CRA          CLEAR MOVE INV. BUSY INDICATOR
-0 04 **          STA*  BAMI
-0 01 **          JMP*  B10C    COMPLETION RETURN
             *
             *
-0 12 **     AM50 IRS*  NTUN    INCR. THE NO. OF UNITS PAST LART SWITCH
 0 01 00511       JMP   *-4     COMP - RETURN
             *
                  EJCT
             *
             *                  CONSTANTS, XAC'S, TEMP STORAGE, ETC
             *
 100000      AM2L OCT   100000 AMI2 OVL-A LOCATOR (0 WITH SIGN SET)
 0 000000    AM1X DAC   **      INDEX-BASE FOR PUSH-UP OF CCT TABLES 1-17
 0 000000    AM2X DAC   **      INDEX-BASE FOR PUSH-UP OF CCT TABLES 18-19
 000000      AMCN DEC   0       PUSH-UP CNTR
 000370      370M OCT   370
 000377      377M OCT   377
             *
             XCCT BSS   12      CAR CONTROL TABLE ENTRIES USED BY AMI FUNCTIONS
             *    +0    CTID
             *    +1    CTOR
             *    +2    CTL1
             *    +3    CTL2
             *    +4    CTSN
             *    +5    CTCG
             *    +6    CTWT
             *    +7    CTT2
             *    +8    CTMX
             *    +9    CTTD
             *    +10   CTMG
             *    +11   CTC1
             *
 000000      XTLS BSZ   9       TL ITEM IMAGE OF CAR FOR USE BY AMI FUNCTIONS
 000000
 000000
 000000
 000000
 000000
 000000
 000000
 000000
 000000           OCT   0       ORIGINAL TLST WT/TONS
 000000           OCT   0       MSB - BINARY SCALE WT.
 000000           OCT   0       LSB - BINARY SCALE WT.
             *
             *
             *
 000776           FIN
 000060
             *                  XAC'S
             *
 0 000000    AGND XAC   AGND
 0 000000    B10C XAC   B10C    FUNC COMPLETE RTN---FREE CORE-C
 0 000000    B13A XAC   B13A    QUEUE FUNC TO OVL-A
 0 000000    BAMI XAC   BAMI    AMI FUNCS TO PROCESS FLAG CNTR
 0 000000    CTB  XAC   CTB     SEQN DIRECTION PARAM - 1 B TO C +1 C TO B
 0 000000    CTID XAC   CTID    ADR OF 1ST CAR CONTROL TABLE
 0 000000    CTMX XAC   CTMX    ADR OF CTMX TABLE OF CCT
 0 000000    CTZN XAC   CTZN    ADR OF CTZN TABLE OF CCT
 0 000000    KAMI XAC   KAMI    NEED FOR AMI CNTR FLAG
 0 000000    KX   XAC   KX      SEQN ON ZONE PARAM
 0 000000    NMX  XAC   NMX     NUMER OF CARS IN CAR CONTROL TABLES
 0 000000    NTUN XAC   NTUN    NO. OF UNITS PAST LAST SWITCH
 0 000000    SEQN XAC   SEQN    DETERMINE OLDEST CAR IN ZONE BY DIRECTION
 0 000000    SQX  XAC   SQX     ENTRY NUMBER OF OLDEST CAR (RELV 1)
             *
                  EJCT
```

```
                 * PROGRAM NAME  -  AMI2
                 *
                 *    AMI2          AUTOMATIC MOVE INVENTORY PART (2)  OVL-A
                 *
                 *
                 *
                      REL
                      EXD
                 *
                 ****               BASE SECTOR ZERO EQU'S
                 *
                      LIST
                 *
                 * END OF SECTOR ZERO EQU'S
                 *
                      SUBR AMI2     ENTRY
                 *
                 *
 0 02 00601 AMI2 LDA   ='144000  HOO HUMP LEAD
-0 10 00525      JST*  CTBZ     TEST TRACK BUSY
 0 01 00005      JMP   AM50     NO
-0 10 00517      JST*  B110     YES---RESCHEDULE FOR ANOTHER TRY
 0 000000        DAC   AMI2
                 *
 0 02 00601 AM50 LDA   ='144000  HOO HUMP LEAD
-0 10 00536      JST*  STBZ     SET TRACK BUSY
                 *
 0 02 00123 AM51 LDA   1P       FOR BUSY CNT
-0 10 00524      JST*  CK5      GET 512 WORD SYSTEM BUFFER
 0 01 00014      JMP   AM52     NONE AVAILABLE---RESCHEDULE
 0 04 00500      STA   BUF1     SAVE BUFF ADR
 0 01 00016      JMP   AM53
                 *
-0 10 00517 AM52 JST*  B110     RESCHEDULE RETURN
 0 000007        DAC   AM51
                 *
                 *
                 *
 0 02 00502 AM53 LDA   HLDA     HOO PACKED DISK TRK ADDR--TTAD FORMAT
-0 10 00546      JST*  ISRL     INIT READ OF HL TRACK LIST
 000001          DEC   1        AT START OF SECTOR SPECIFIED BY LINE NUMBER
 0 000500        DAC   BUF1     ADR OF BUFF ADR WORD
 0 000451        DAC   AM90     ADR OF DISC ERR ROUTINE
 0 01 00453      JMP   AM92     NO DATA---LOGIC BUG
                 *
-0 35 00554 AM55 LDX*  P$RL     ADDR. OF TLST ITEM
 1 02 00003      LDA   3,1      GET MASTER RELV DISC ADR BITS 3-16
-0 05 00543      ERA*  XCCT     TEST IF MATCHES STORED CAR ID
 0 03 00140      ANA   37K7
 101040          SNZ
 0 01 00035      JMP   AM56     YES
                 *
-0 10 00551      JST*  G$RL     GET THE NEXT TLST ITEM
 0 01 00453      JMP   AM92     END OF TL DATA---NO MATCH---MUST BE UNIT
 0 01 00024      JMP   AM55     ANOTHER ITEM
                 *
 0 15 00041 AM56 STX   AM57+2   SET SCAT MOVE FROM ADR PARAM
 0 15 00045      STX   AM58+2   SET U110 CLEAR AREA ADR PARAM
                 *
-0 10 00534 AM57 JST*  SCAT     MOVE TL ITEM
 177767          DEC   -9       NEGATIVE NO. WDS IN A TLST ENTRY
 0 000000        DAC   **       FROM TL BUFFER
 0 000000        XAC   XTLS     TO IN-CORE STORAGE
                 *
 0 02 00040 AM58 LDA   AM57+1   NEGATIVE TL ITEM WORD CNT
-0 10 00545      JST*  U118     CLEAR TL ITEM
 0 000000        DAC   **       IN TL BUFFER
                 *
 0 35 00143      LDX   OP       DETERMINE TL SECTOR OF ITEM
-0 02 00552      LDA*  L$RL     ITEM LINE NO
 0 11 00577      CAS   =112     TEST IN 3RD SECTOR
 0 12 00000      IRS   0        YES--STEP INDEX
 101000          NOP            NO
 0 11 00576      CAS   =56      TEST IN 2ND OR 3RD SECTOR
 0 12 00000      IRS   0        YES--STEP INDEX
```

```
101000          NOP          NO
            *
            *
            *
-0 02 00530 AM59 LDA*  HLC
 0 07 00123      SUB   1P     DECREMENT THE HUMP FILE COUNT
 100400          SPL
 1400040         CRA
-0 04 00530      STA*  HLC
            *
-0 10 00555      JST*  W$RL   WRITE BACK TO DISK TL IN CORE SECT OF HUMP LEAD
            *
 0 02 00601      LDA   ='144000  H00 HUMP LEAD
-0 10 00533      JST*  RTBZ   CLEAR TRACK BUSY FLAG
            *
                 EJCT
            *
            *    AM60         MOVE AXLE CNT FROM XCCT TO XTLS
            *
 0 35 00544 AM60 LDX   XTLS   ADR OF STORED TL ITEM
 1 02 00003      LDA   3,1    GET WORD CONTAINING AXLE CNT  BITS 1-2
 0414 76         LGL   2      STRIP OLD CNT
 000201          IAB
-0 02 00543      LDA*  XCCT   GET NEW AXLE CNT FROM XCCT  BITS 1-2
 0416 76         ALR   2
 0400 76         LRL   2      COMBINE WITH TL ITEM WORD
 000201          IAB
 1 04 00003      STA   3,1    UPDATE STORED TL ITEM
            *
 0 35 00543 AM66 LDX   XCCT   ADR OF XCCT CAR CONTROL TABLE INFO
            *
 0 02 00763      LDA   PTIM
 100040          SZE          TEST IF TRIM IN PROGRESS
 0 01 00234      JMP   WCE6   YES
            *
 1 02 00006      LDA   6,1
 100040          SZE          TEST FOR VALID WEIGHT
 0 01 00114      JMP   WCE1   YES
 1 02 00023      LDA   19,1   NO
 101400          SMI          TEST IF CAR WAS TO BE SCALED
 0 01 00234      JMP   WCE6   NO
            *
 0 02 00512      LDA   GWCE
-0 10 00521      JST*  B13A   YES--QUEUE THE INVALID WEIGHT MESSAGE
 0 01 00233      JMP   WCE5
            **
 001001     WGE1 INH
            **
 1 02 00006      LDA   6,1    CCC WEIGHT (LSB)
 000201          IAB
 1 02 00013      LDA   11,1   CCT WEIGHT (MSB)
-0 10 00557      JST*  GBIN   CONVERT THE WEIGHT TO BINARY/10
 1 04 00026      STA   22,1
 000201          IAB
 1 04 00027      STA   23,1   SAVE THE CONVERTED BINARY CCT WEIGHT
 000201          IAB
            **
 000401          ENB
 0 01 00127      JMP   *+1
            **
-0 10 00556      JST*  DIV    DIV THE BINARY WT BY 200 TO CONV TO TONS
 0 000516        DAC   P200
            *
 141050          CAL
 0 04 00511      STA   TPWT   SAVE FOR OR WITH TLST
 1 02 00022      LDA   18,1
 1 04 00025      STA   21,1   SAVE THE ORIG TLST WEIGHT
 141044          CAR          CLEAR BITS 6-16
 0 05 00511      ERA   TPWT   OR IN THE NEW WEIGHT
 1 04 00022      STA   18,1
            *
 1 02 00023      LDA   19,1
 101400          SMI          TEST IF CAR WAS TO BE SCALED
```

```
0 01 00157        JMP   WCE2     NO
140100            SSP
1 04 00023        STA   19,1     CLEAR THE WEIGH BIT
1 02 00025        LDA   21,1
141050            CAL            SET SCALE BIT FLAG FOR GWCE
140500            SSM
1 04 00025        STA   21,1
          *
0 02 00512        LDA   GWCE
0414 77           LGL   1
140500            SSM            SET GWCE ENTRY CODE = 1
0404 77           LGR   1
-0 10 00521       JST*  B13A     QUEUE GWCE FUNCT
0 01 00233        JMP   WCE5
          *
1 02 00025 WCE2   LDA   21,1
141050            CAL            CLEAR BITS 1-8 OF ORIG TLST WEIGHT
1 04 00025        STA   21,1
          *
1 02 00022        LDA   18,1     TLST SCALE WEIGHT TONS
141050            CAL
0 11 00575        CAS   =160     TEST FOR SYSTEM OVERWEIGHT
0 01 00170        JMP   *+3      YES
101000            NOP
0 01 00174        JMP   WCE3     NO
          *
0 02 00512        LDA   GWCE
140500            SSM            SET GWCE ENTRY CODE - 2
-0 10 00521       JST*  B13A     QUEUE GWCE FUNCT
0 01 00233        JMP   WCE5
          *
1 11 00022 WCE3   CAS   18,1     TEST FOR CONSIST OVERWEIGHT
0 01 00200        JMP   *+3      YES
101000            NOP
0 01 00204        JMP   WCE4     NO
          *
0 02 00512        LDA   GWCE
140500            SSM            SET GWCE ENTRY CODE = 2
-0 10 00521       JST*  B13A     QUEUE GWCE FUNCT
0 01 00233        JMP   WCE5
          *
0 02 00544 WCE4   LDA   XTLS     ADDR OF TLST ITEM
-0 10 00566       JST*  SERM     FIND SERIES MATCH
0 000000          XAC   SIT      ADDR OF SERIES LIMIT TABLE
177766            DEC   -10      NEG. NO. OF ITEMS IN SLT
100000            SKP
0 01 00234        JMP   WCE6     NO SERIES MATCH
          *
-0 35 00563       LDX*  SRPT     SLT ITEM ADDR
1 02 00002        LDA   2,1
0400 74           LRL   4        LBS
1 02 00001        LDA   1,1
0410 74           LLL   4        MSB
141050            CAL
0 04 00511        STA   TPWT
0 35 00543        LDX   XCCT
1 02 00022        LDA   18,1
141050            CAL
0 11 00511        CAS   TPWT     TEST FOR SERIES OVERWEIGHT
0 01 00230        JMP   *+3      YES
100000            SKP            YES
0 01 00234        JMP   WCE6     NO
0 02 00512        LDA   GWCE
140500            SSM            SET GWCE ENTRY CODE = 2
-0 10 00521       JST*  B13A     QUEUE GWCE FUNCT
0 10 00444 WCE5   JST   CCHK     CHECK IF GWCE WAS QUEUED
          *
0 35 00543 WCE6   LDX   XCCT
1 02 00021        LDA   17,1
140100            SSP            CLEAR THE SWING BIT
1 04 00021        STA   17,1
          *
1 02 00011        LDA   9,1      GET CD CURRENT DESTINATION FROM CTTD  BITS 10-15
```

```
0404 77          LGR   1
0 03 00130       ANA   77M      '77
0 04 00476       STA   AMCD     SAVE
            *
1 02 00002       LDA   2,1      GET OD FROM CTL1 BITS 2-7
0404 67          LGR   9        POSITION IN BITS 11-16
0 05 00476       ERA   AMCD     MATCH WITH CD CURRENT DESTINATION
0 03 00130       ANA   77M      '77
101040           SNZ            TEST FOR MISROUTE
0 01 00255       JMP   *+4      NO
            *
0 02 00503       LDA   MRML     MISROUTE MESSAGE FUNC LOCATOR
-0 10 00521      JST*  B13A     QUEUE MIS-ROUTE FUNCTION TO OVL-A
            *
0 10 00444       JST   QCHK     CHECK IF FUNCTION WAS QUEUED
            *
0 35 00543       LDX   XCCT
            *
1 02 00013       LDA   11,1     GET THE IP BIT
101100           SLN            TEST IF CAR IS FROM AN IP AREA
0 01 00264       JMP   AM68     NO
            *
0 02 00513       LDA   IPML     IP MSG. LOCATOR CODE
-0 10 00522      JST*  B13B     QUEUE IP FUNC TO OVL-B
            *
0 10 00444       JST   QCHK     CHECK IF FUNCTION WAS QUEUED
            *
            *    AM68           TAKE NECESSARY ACTION ON (SH) CODES
            *
0 35 00543  AM68 LDX   XCCT
1 02 00022       LDA   18,1     GET SH CODE FROM TLST+6 BITS 5-8
141140           ICL            AND POSITION IN BITS 13-16
0 03 00126       ANA   17M
101040           SNZ            WAS AN SH CODE ASSIGNED
0 01 00300       JMP   AM70     NO
0 07 00124       SUB   3P       IS IT IN SP OR ST CODE
100400           SPL
0 01 00300       JMP   AM70     NO
1 02 00022       LDA   18,1     BLANK OUT CODE
0 03 00574       ANA   ='170377
1 04 00022       STA   18,1
            *
            *
            *
            *
            *    AM70           MOVE CAR INVENTORY FROM XTLS TO BOWL TRACK LIST
            *
0 02 00476  AM70 LDA   AMCD     CURRENT DESTINATION BOWL TRACK NO. (1-48)
0 07 00123       SUB   1P
0 04 00000       STA   0
-1 02 00541      LDA*  TTAB,1   GET DISC ADR WORD FROM TTAD TABLE
0416 77          ALR   1        GET BUSY FLAG BIT-2
101400           SMI            TEST BUSY
0 01 00311       JMP   AM71     NO
            *
-0 10 00517      JST*  B110     RESCHEDULE RETURN
0 000300         DAC   AM70
            *
140500      AM71 SSM            SET TRACK BUSY FLAG
0406 77          APR   1
-1 04 00541      STA*  TTAB,1   UPDATE TTAD TABLE
-1 02 00542      LDA*  TLLB,1
0 04 00510       STA   TKNM     TRACK NAME
            *
-1 02 00541      LDA*  TTAB,1   TLST DISK ADDRESS
-0 10 00547      JST*  I$WL     INIT TL WRITE OF BOWL TRACK
177777           DEC   -1       AT END
0 000500         DAC   BUF1     ADR OF BUFF ADR WORD
0 000460         DAC   AM94     ADR OF DISC ERR ROUTINE
0 01 00340       JMP   AM73     TL FULL---CAR NOT ADDED
            *
0 04 00000  AM72 STA   0
0 02 00510       LDA   TKNM     PACKED TRACK NUM
            *
```

```
-0 10 00527        JST*  TK$C     GET TRACK CAPACITY
                 *
 0 07 00000        SUB   0
 0 06 00121        ADD   4P       IS INVENTORY WITHIN 5 OF FULLS
 100040            SZE
 0 01 00344        JMP   AM74     NO
                 *
 0 02 00476        LDA   AMCD     BOWL TRACK NUMBER (1-48)
 0414 67           LGL   9        POSITION IN BITS 2-7
 0 05 00477        ERA   BNLL     BOWL NEAR LIMIT MESSAGE FUNC LOCATOR
-0 10 00521        JST*  B13A     QUEUE BOWL NEAR LIMIT FUNC TO OVL-A
 0 01 00344        JMP   AM74
                 *
 0 02 00501 AM73   LDA   CNAL     CAR NOT ADDED FUNC LOCATOR
-0 10 00521        JST*  B13A     QUEUE CAR NOT ADDED FUNC TO OVL-A
                 *
 0 10 00444        JST   QCHK     CHECK IF FUNCTION WAS QUEUED
 0 01 00364        JMP   AM75
                 *
                 *
 0 02 00544 AM74   LDA   XTLS     ADR OF CAR ITEM TO BE ADDED
-0 10 00553        JST*  M$WL     MOVE AND GIVE CAR TO BOWL TL
 100000            SKP            NOW FULL
                 *
-0 10 00550        JST*  E$WL     END WRITE OF TL
                 *
 0 02 00763        LDA   PTIM
 100040            SZE            TEST IF TRIM IN PROGRESS
 0 01 00364        JMP   AM75     YES
                 *
                 *
                 *
                 * AM76            QUEUE SPEED ERROR FUNC
                 *
-0 02 00535 AM76   LDA*  SEP      HAS A SPEED ERROR PRINT BEEN REQUESTED
 101040            SNZ
 0 01 00361        JMP   AM77     NO

 0 02 00504        LDA   SEL      SPEED ERROR FUNCTION LOCATOR
-0 10 00521        JST*  B13A     QUEUE SPEED ERROR FUNCTION TO OVL-A
                 *
 0 10 00444        JST   QCHK     CHECK IF FUNCTION WAS QUEUED
                 *
                 *
                 *    AM77        QUEUE AS HUMPED FUNCTION (AH1)
                 *
 0 02 00505 AM77   LDA   AH1L     AH1 LOCATOR CODE
-0 10 00521        JST*  B13A     QUEUE AH1 TO OVL-A
                 *
 0 10 00444        JST   QCHK     CHECK IF FUNCTION WAS QUEUED
                 *
 0 02 00476 AM75   LDA   AMCD     SET X-REG BOWL TRACK NO. -1 (0-47)
 0 04 00000        STA   0
-1 02 00541        LDA*  TTAB,1   GET DISC ADR WORD FROM TABLE TTAD
 0 03 00140        ANA   37K7     CLEAR BUSY FLAG
-1 04 00541        STA*  TTAB,1   UPDATE TTAD TABLE WORD
                 *
-0 02 00530 AM78   LDA*  HLC      TEST HUMP LEAD EMPTY
 100040            SZE            =0 YES
 0 01 00470        JMP   AM99     NO---CAR DATA REMAINING---RELEASE BUFF AND RETURN
                 *
 0 02 00763        LDA   PTIM
 100040            SZE            TEST IF TRIM IN PROGRESS
 0 01 00470        JMP   AM99     YES
                 *
                 *
                 *    AM82        QUEUE AS HUMPED FUNCTION (AH2)
                 *
 0 02 00506 AM82   LDA   AH2L     AH2 LOCATOR CODE
-0 10 00522        JST*  B13B     QUEUE AH2 TO OVL-2
                 *
 0 02 00514        LDA   MRSL     QUEUE MRS TO OVL-B
-0 10 00522        JST*  B13B
                 *
 0 35 00573        LDX   = -20
 140040            CRA
```

```
-1 04 00540        STA*  TTCE,1  CLEAR THE TABLE OF TAGGED CLASS CODES
 0 12 00000        IRS   '0
 0 01 00406        JMP   *-2
                 *
 0 02 00537        LDA   TSA
 0 03 00572        ADD   =48
 0 04 00537        STA   TSA
                 *
 0 35 00571        LDX   =-48
 140040            CRA
-1 04 00537        STA*  TSA,1   CLEAR THE SWING ASSIGNMENT TABLE
 0 12 00000        IRS   '0
 0 01 00416        JMP   *-2
                 *
                 *         AUTO TRIM DETERMINATION LOGIC
                 *
-0 02 00560        LDA*  KTMV
 101040            SNZ           TEST IF TRIM MOVE PENDING
 0 01 00430        JMP   ATM1    NO
                 *
 0 02 00515        LDA   TMLC    YES--GET TM LOC CODE
 140500            SSM           SET BIT 1
-0 10 00522        JST*  B13B    QUEUE TM FOR MESSAGE O/P
 0 01 00470        JMP   AM99    CLEAN UP AND EXIT
                 *
-0 02 00561 ATM1   LDA*  KTWV
 100040            SZE           TEST FOR VALID TW ASSIGNMENT
 0 01 00437        JMP   *+5     YES
 0 02 00507        LDA   ESCP    NO---LINE THE PREDEFINED ESCAPE ROUTE
-0 04 00564        STA*  TTWA
 0 02 00123        LDA   1P
-0 04 00565        STA*  NTWA
-0 12 00531        IRS*  INSP    REQUEST INTERNAL HUMP STOP
 0 02 00570        LDA   =17
 0 04 00172        STA   HPSR    HUMP STOP REASOM
-0 12 00562        IRS*  MTRO
                 *
 0 01 00470        JMP   AM99    RELEASE BUFF AND RETURN
                 *
                 *   QCHK        CHK IF "A" QUEUE SATURATED
                 *
 0 000000   QCHK   DAC   **
 101040            SNZ           A-REG = IF SYSTEM SATURATED
-0 01 00444        JMP*  QCHK    ERROR RTN - BAMI NOT INCREMENTED
-0 12 00523        JMP*  QCHK    INCREMENT AMI BUSY
-0 01 00444        JMP*  QCHK    RTN
                 *
                   EJCT
                 *
                 *               ERROR ROUTINES AND CLEANUP
                 *
 0 35 00117 AM90   LDX   16P     HUMP LEAD DISC ERROR
 0 01 00454        JMP   AM92+1
                 *
 0 35 00600 AM92   LDX   =100    UNIT IN BOWL AREA
                 *
 0 02 00601        LDA   ='144000  HOO HUMP LEAD PACKED TRACK NUMBER
-0 10 00533        JST*  RTBZ    CLEAR TRACK BUSY FLAG
                 *
 0 02 00000        LDA   0       ERR CODE
 0 01 00466        JMP   AM96
                 *
 0 35 00476 AM94   LDX   AMCD    BOWL TRACK NUMBER (1-48)
 0 07 00123        SUB   1P
-1 02 00541        LDA*  TTAB,1  GET DISC ADR WORD FROM TABLE TTAD
 0 03 00140        ANA   37K7    CLEAR BUSY FLAG
-1 04 00541        STA*  TTAB,1  UPDATE TTAD TABLE WORD
                 *
 0 02 00117        LDA   16P     BOWL TRACK DISC ERROR
                 *
 0 35 00567 AM96   LDX   =11     TYC KSR-B DEVICE NUMBER
-0 10 00532        JST*  MER1    QUEUE ERROR CODE
                 *
```

```
-0 02 00523 AM99 LDA*  BAMI
 0 07 00123      SUB   1P      DECREMENT AMI FUNCS TO PROCESS CNT AMI2 COMPLETED
-0 04 00523      STA*  BAMI
                 *
 0 02 00500      LDA   BUF1    BUFFER ADDRESS
-0 10 00526      JST*  DBZF    RELEASE SYSTEM BUFFER
                 *
-0 01 00520      JMP*  B10A    FUNC COMPLETE RETURN---FREE OVL-A
                 *
                 EJCT
                 *
                 *             CONSTANTS, XAC'S, TEMP STORAGE, ETC
                 *
000000           AMCD DEC  0   CAR CURRENT DESTINATION BOWL TRACK NUMBER (1-48)
000014           BNLL DEC  12  BOWL NEAR LIMIT FUNC LOCATOR
0 000000         BUF1 DAC  **  512 WORD SYSTEM BUFFER ADR
000005           CNAL DEC  5   CAR NOT ADDED FUNC LOCATOR
102312           HLDA OCT  102312 HOO HUMP LEAD DISC ADR WORD SEC-00 HD-9 TRK-74
000012           MRML DEC  10  (MR) MIS-ROUTE FUNCTION LOCATOR
000013           SEL  DEC  11  SPEED ERROR FUNC LOCATOR
000011           AH1L DEC  9   LOCATOR CODE FOR AH1
000201           AH2L DEC  129 LOCATOR CODE FOR AH2
                 *
000001           ESCP DEC  1
000000           TKNM OCT  0
000000           TPWT OCT  0
000024           GWCE DEC  20
100277           IPML OCT  100277
000166           MRSL DEC  118
000325           TMLC DEC  213
000310           P200 DEC  200
                 *             XAC'S
000763           PTIM EQU  '763
000172           HPSR EQU  '172
                 *
0 000000         B110 XAC  B110  RESCHEDULE RTN
0 000000         B10A XAC  B10A  FUNC COMPLETE RTN---FREE OVL-A
0 000000         B13A XAC  B13A  QUEUE FUNC TO OVL-A
0 000000         B13B XAC  B13B  QUEUE FUNC TO OVL-B
0 000000         BAMI XAC  BAMI  AMI FUNCS TO PROCESS CNTR FLAG
0 000000         CK5  XAC  CK5   GET 512 WD SYS BUFF
0 000000         CTBZ XAC  CTBZ  CHECK TRACK BUSY
0 000000         DBZF XAC  DBZF  RELEASE SYS BUFF
0 000000         TK$C XAC  TK$C  TRACK CAP LOOKUP SUBR
0 000000         HLC  XAC  HLC   TOTAL CARS ON HL CNT
0 000000         INSP XAC  INSP
0 000000         MER1 XAC  MER1  QUEUE ERR CODE
0 000000         RTBZ XAC  RTBZ  CLEAR TRACK BUSY
0 000000         SCAT XAC  SCAT
0 000000         SEP  XAC  SEP
0 000000         STBZ XAC  STBZ  SET TRK BUSY
0 000000         TSA  XAC  TSA
0 000000         TTCE XAC  TTCE
0 000000         TTAB XAC  TTAD  TTAD TBL BASE FOR BOWL NUMBER (1-48) ACCESSING
0 000000         TLLB XAC  TLLU
0 000000         XCCT XAC  XCCT  CORE STORAGE OF CAR CTRL TABLE INFO
0 000000         XTLS XAC  XTLS  CORE STORAGE OF CAR TL ITEM
0 000000         U110 XAC  U110  CLEAR CORE
0 000000         I$RL XAC  IARL
0 000000         I$WL XAC  IAWL
0 000000         E$WL XAC  EAWL
0 000000         G$RL XAC  GARL
0 000000         L$RL XAC  LARL
0 000000         M$WL XAC  MAWL
0 000000         P$RL XAC  PARL
0 000000         W$RL XAC  WARL
0 000000         DIV  XAC  DIV
0 000000         GBIN XAC  GBIN
0 000000         KTMV XAC  KTMV
0 000000         KTWV XAC  KTWV
0 000000         MTRQ XAC  MTRQ
0 000000         SRPT XAC  SRPT
0 000000         TTWA XAC  TTWA
0 000000         NTWA XAC  NTWA
```

```
 0 000000    SERM XAC   SERM
             *
             *
 000013           FIN
 000021
 177720
 000060
 177754
 170377
 000240
 000070
 000160
 000144
 144000
                  ORG   '777
 000000           DEC   0
                  END

             * PROGRAM NAME  -  AMI3-BOWL HOO UPDATE-AUTO MOVE INVENTORY #3
             *
             *
                  EXD
                  REL
                  CF5
             *
                  EJCT
             *
             *    105-110
             *
 0404 67     B001 LGR   9        RIGHT JUSTIFY THE BOWL TRACK NO.
 0 07 00322       SUB   =1       SUB 1 AND SAVE AS
 0 04 00242       STA   BWLX     INDEX TO TLLO
             *
             *    115-125
             *
-0 02 00302       LDA*  NTUN     GET THE NO. OF TRIM UNITS
 101040           SNZ            TEST IF ZWRO
 0 01 00011       JMP   *+4      YES
             *
 101400           SMI            NO---TEST IF EAST END
 0 01 00126       JMP   B035     WEST END
 0 04 00243       STA   ETGL     EAST END--SET EAST EMD TOGGLE
             *
             *    130
             *
 0 02 00322 B005  LDA   =1       BUFF BUSY COUNT
-0 10 00266       JST*  CK5      OBTAIN A FREE 512 WRD BUFFER
 100000           SKP            BUSY RETURN
 0 01 00017       JMP   *+3      FOUND
             *
             *    135
             *
-0 10 00265 B010  JST*  B110     BUSY--SCHEDULE EXEC RETURN TO 512 WRD BUFF CHECK
 0 000011         DAC   B005
             *
             *    140
             *
 0 04 00246       STA   BUF1     SAVE THE 512 BUFF ADDR
 0 35 00242       LDX   BWLX
-1 02 00306       LDA*  TLLU,1   GET THE TLST TRACK NAME
 0 04 00244       STA   TKNM     SAVE IT FOR 0360, CTBZ, STBZ, RTBZ
             *
             *    145-155
             *
-0 10 00307       JST*  0360     GET THE TLST DISK ADDR
 101040           SNZ
 000000           HLT            ILLEGAL TRACK--IMPOSSIBLE
 0 04 00245       STA   TKAD     SAVE FOR $WL
             *
             *    160-170
             *
 0 02 00244       LDA   TKNM
-0 10 00267       JST*  CTBZ     TEST IF TRACK BUSY
 0 01 00035       JMP   *+4      FREE
```

```
                *
 0 02 00246 B015 LDA    BUF1
-0 10 00270      JST*   DBZF     RELEASE THE 512 WRD SYS BUFF
 0 01 00015      JMP    B010     SO RESCHEDULE
                *
                *    175
                *
 0 02 00244      LDA    TKNM
-0 10 00305      JST*   STBZ     SET THE BOWL TLST BUST
                *
                *    200-215
                *
 0 02 00247      LDA    HOOM
-0 10 00267      JST*   CTBZ     TEST IF HOO BUSY
 0 01 00045      JMP    *+4      FREE
                *
 0 02 00244      LDA    TKNM
-0 10 00303      JST*   RTBZ     BUSY--RELEASE THE BOWL TLSR
 0 01 00032      JMP    B015     GO RELEASE BUF1 & RESCHEDULE
                *
 0 02 00247      LDA    HOOM
-0 10 00305      JST*   STBZ     SET HOO BUSY
                *
                *    220
                *
 0 02 00245      LDA    TKAD     TLST DISK ADDR
-0 10 00274      JST*   I$WL     INIT A WRITE LIST AT LAST ITEM + 1
 177777          DEC    -1
 0 000246        DAC    BUF1     ADDR OF 512 WORD BUFFER ADDRESS
 0 000233        DAC    WLDE     ADDRESS OF DISK ERROR ROUTINE
 101000          NOP             ---NO TLST DATA
                *
-0 02 00246      LDA*   BUF1
 101040          SNZ             TEST IF TLST EMPTY
 0 01 00113      JMP    B030     YES
                *
                *    225
                *
-0 02 00300      LDA*   P$WL
 0 07 00241      SUB    WTLS     DETERMINE ADDRESS OF WEST TLST ITEM
-0 04 00300      STA*   P$WL
 0 04 00071      STA    B020     SAVE FOR SCAT
 0 04 00077      STA    B023
 0 04 00104      STA    B025     SAVE FOR U110
                *
                *    235
                *
                *
                **
 001001          INH
                **
                *
-0 10 00304      JST*   SCAT     MOVE THE TLST ITEM TO THE TRIM INTERFACE BUFFER
 0 177767        DAC    -WITM
 0 00 00000 B020 ***    **
 0 000000   TBCD XAC    TBCD
                *
                **
 000401          ENB
 0 01 00075      JMP    *+1
                **
                *
-0 10 00304      JST*   SCAT     MOVE THE TLST ITEM TO TEMP BUFFER
 0 177767        DAC    -WITM
 0 00 00000 8023 ***    **
 0 09 0252       DAC    TBUF
                *
                *    232
                *
 0 02 00241      LDA    WTLS
 140407          TCA
-0 10 00311      JST*   0110     ZERO THE LAST TLST ITEM
 0 00 00000 B025 ***    **
                *
                *    235
                *
```

```
-0 02 00246          LDA*  BUF1
 0 07 00322          SUB   =1        DECREMENT THE NO OF TLST ITEMS
 101400        SMI
-0 04 00246          STA*  BUF1
               *
               *     240
               *
-0 10 00271          JST*  E$WL      WRITE THE IN-CORE TLST BACK TO DISK
               *
 0 01 00150          JMP   B040
               *
               *
               *
 0 02 00243    B030  LDA   ETGL      TEST IF EAST END TOGGLE SET
 100400              SPL
 0 01 00126          JMP   B035      YES--TRIM ENG ORIG IN BOWL TRK
               *
 0 02 00320          LDA   =357      NO TLAT DATA--ERROR
 0 35 00251          LDX   DVNO
-0 10 00277          JST*  MER1      QUEUE THE ERROR MSG FOR O/P
               *
 0 02 00243          LDA   ETGL
 140500              SSM             SET ETGL TO FORCE BUFF & TLST RELEASE
 0 04 00243          STA   ETGL
 0 02 00322          LDA   =1
 0 01 00135          JMP   B038
               *
               *     300-305
               *
-0 02 00302    B035  LDA*  NTUN      NO. OF TRIM ENGINES
 0 07 00322          SUB   =1
 100400              SPL
 140040              CRA
-0 04 00302          STA*  NTUN      DECREMENT THE NO. OF TRIM ENGINES
 0 04 00000          STA   '0
-1 02 00310          LDA*  UNXL,1    GET THE NO OF UNIT AXLES
               *
 140500        B038  SSM             SET BIT TO INDICATE COMPUTER ADDED ID
 0406 76             ARR   2         POSITION CPU BIT AND AXLE COUNT
 0 05 00317          ERA   ='340
-0 05 00263          ERA*  ACTR      CREATE UNIQUE ID FOR PC
-0 12 00263          IRS*  ACTR
               *
               *     310
               *
 0 35 00072          LDX   TBCD
 1 04 00003          STA   3,1       UPDATE THE TRIM INTERFACE BUFFER
               *
               *     315
               *
 0 02 00243          LDA   ETGL      EAST END TOGGLE
 101400              SMI             TEST IF SET
-0 01 00264          JMP*  B10A      NO--RETURN CONTROL TO THE EXEC & RELEASE OVL-A
 0 01 00224          JMP   B055      YES--GO RELEASE TLST'S & BUFFERS
               *
               *     325
               *
 0 02 00250    B040  LDA   NOAD      HOO DISK ADDRESS
-0 10 00275          JST*  I$RL      INITIALIZE A WRITE LIST
 000001              DEC   1         AT LINE NO. 1
 0 000246            DAC   BUF1      ADDRESS OF BUFFER ADDRESS
 0 000233            DAC   WLDE      ADDRESS OF DISK ERROR ROUTINE
 101000              NOP             NO DATA--IGNORE
               *
               *     330
               *
-0 35 00301    B045  LDX*  P$RL
 1 02 00000          LDA   0,1       TEST FOR ZERO TLST ITEM
 101040              SNZ
 0 01 00211          JMP   B050      YES
               *
               *
               *
-0 02 00276          LDA*  L$RL      RL ITEM LINE NO
-0 05 00273          ERA*  HLC
```

```
100040          SZE              TEST IF LAST RL ITEM
 0 01 00202     JMP   B047       NO--GET NEXT TLST ITEM
              *
-0 02 00276     LDA*  L$RL       YES
 0 11 00315     CAS   =112       TEST IF LAST ITEM OF 2ND. SECTOR
 0 01 00175     JMP   B046       NO--ITEM IN 3RD. SECTOR
 0 01 00202     JMP   B047       YES--GET NEXT SECTOR
 0 11 00314     CAS   =56        NO--TEST IF LAST ITEM OF 1ST. SECTOR
100000          SKP              NO--ITEM IN 2ND. SECTOR
 0 01 00202     JMP   B047       YES--GET NEXT SECTOR
              *
-0 02 00301 B046 LDA* P$RL       NO--SET UP P$RL
 0 06 00241     ADD   WTLS       FOR TLST RL UPDATE
-0 04 00301     STA*  P$RL
-0 12 00276     IRS*  L$RL       BUMP THE RL ITEM COUNT
 0 01 00205     JMP   B048
              *
              *  335
              *
-0 10 00272 B047 JST* G$RL       GET THE NEXT HOO ITEM
100000          SKP              --END OF DATA
 0 01 00156     JMP   B045
              *
              *  340
              *
-0 02 00276 B048 LDA* L$RL       GET THE RL ITEM LINE NO
 0 07 00313     SUB   =168       TEST IF = 168
101040          SNZ
 0 01 00235     JMP   CARE       YES--HOO FULL
              *
              *  345-355
              *
-0 10 00304 B050 JST* SCAT       X-FER THE BOWL TSLST ITEM TO HOO
 0 177767       DAC   -WITM
 0 000252       DAC   TBUF
-0 000000       XAC*  PARL
              *
-0 02 00246     LDA*  BUF1       TLST SECTOR COUNT
 0 11 00314     CAS   =56        TEST FOR FULL COUNT
 0 01 00222     JMP   B055-2     YES--DO NOT INCR
 0 01 00222     JMP   B055-2     YES--DO NOT INCR
-0 12 00246     IRS*  BUF1       NO---INCR THE SECTOR COUNT
              *
-0 12 00273     IRS*  HLC        INCREMENT THE HUMP LEAD COUNT
              *
-0 10 00512     JST*  W$RL       WRITE THE IN-CORE TLST BACK TO DISK
              *
              *  370
              *
 0 02 00244 B055 LDA  TKNM
-0 10 00303     JST*  RTBZ       RELEASE THE BOWL TLST
              *
              *  375
              *
 0 02 00247     LDA   HOOM
-0 10 00303     JST*  RTBZ       RELEASE HOO
              *
 0 02 00246     LDA   BUF1
-0 10 00207     JST*  DBZF       RELEASE THE 512 WD SYSTEM BUFFER
              *
-0 01 00264     JMP*  B10A       RELEASE OVL-A & RETURN CONTROL TO THE EXEC
              **
              **
              **
              **
              *  420
              *
 0 02 00316 WLDE LDA  =356       ERROR--DISK ACCESS
100000          SKP
              *
 0 02 00321 CAPE LDA  =358       ERROR---HOO CAPACITY EXEDED
 0 35 00251 B060 LDX  DVNO
-0 10 00277     JST*  MER1       QUEUE THE ERROR MESSAGE
```

```
0 01 00224        JMP   B055
                  *
                  *
                  *
                  *
000011            WITM EQU   '11
0 000011          WTLS DAC   WITM
                  *
                  *
                  *
000000            BWLX OCT   0
000000            ETGL OCT   0
000000            TKNM OCT   0
000000            TKAD OCT   0
000000            BUF1 OCT   0
144000            HOOM OCT   144000
102312            HOAD OCT   102312
000010            DVNO OCT   10
                  *
000000            TBUF BSZ   9
000000
000000
000000
000000
000000
000000
000000
000000
000000
                  *
000000            ACTR XAC   ACTR
0 00000           B10A XAC   B10A
0 000000          B110 XAC   B110
0 000000          CK5  XAC   CK5
0 000000          CTBZ XAC   CTBZ
0 000000          DBZF XAC   DBZF
0 000000          E$WL XAC   EAWL
0 000000          G$RL XAC   GARL
0 000000          HLC  XAC   HLC
0 000000          I$WL XAC   IAWL
0 000000          I$RL XAC   IARL
0 000000          L$RL XAC   LARL
0 000000          MER1 XAC   MER1
0 000000          P$WL XAC   PAWL
0 000000          PWRL XAC   PARL
0 000000          NTUN XAC   NTUN
0 000000          RTBZ XAC   RTBZ
0 000000          SCAT XAC   SCAT
0 000000          STBZ XAC   STBZ
0 000000          TLLU XAC   TLLU
0 000000          U360 XAC   U360
0 000000          UNXL XAC   UNXL
0 000000          U110 XAC   U110
0 000000          W$RL XAC   WARL
                  *
000250                FIN
000070
000160
000544
000340
000545
000546
000001
                  *
                      ORG    '777
000030                DEC    24
                      END

                  * PROGRAM NAME  -  AMI4  PG. 2-CREST TCHF, HFDP UPDATE, PAGE 2 OVL - A
                  *
                  *
                  * CONFIGURATION
                  *
```

```
                EXD
                REL
                CF5
            *
                EJCT
            *
            *   215
 0 35 00575 CM30 LDX   CHF
 1 02 00003      LDA   3,1       OLDEST TCHF ITEM ID
 0 03 00616      ANA   ='37777   CLEAR BITS 0-2
-0 05 00533      ERA*  BFXA      TEST IF ITEM IS IN TCHF
 101040          SNZ
-0 01 00531      JMP*  B10A      YES---BORT
            *
 0 02 00615      LDA   =1        BUFF, BUSY CNT.
-0 10 00540      JST*  CK5       OBTAIN A FREE 512 WD BUFFER
 0 01 00020      JMP   CM40      --BUSY
 0 04 00522      STA   BUF1      SAVE THE BUFFER ADDR.
            *    220
 0 02 00615      LDA   =1        BUFF BUSY CNT
-0 10 00540      JST*  CK5       OBTAIN A FREE 512 WD BUFFER
 100000          SKP             --BUSY
 0 01 00022      JMP   CM45
            *    225
 0 02 00522      LDA   BUF1      RELEASE THE 1ST 512 WD BUFFER
-0 10 00541      JST*  DBZF
            *    230
-0 10 00530 CM40 JST*  B110      SCHEDULE EXEC. RETURN TO 1ST BUFFER CHECK
 0 000000        DAC   CM30
            *
            *    235
 0 04 00523 CM45 STA   BUF2      SAVE THE BUFFER ADDR.
 0 02 00507      LDA   HOOM      HOO TRACK NAME
-0 10 00537      JST*  CTBZ      TEST IF HOO BUSY
 0 01 00031      JMP   CM48      --NOT BUSY
            *    240
 0 02 00523      LDA   BUF2      HOO BUSY, RELEASE THE
-0 10 00541      JST*  DBZF      2ND 512 WD BUFFER
 0 01 00016      JMP   CM35      GO RELEASE 1ST BUFFER AND RESCHEDULE
            *
            *    250
 0 02 00507 CM48 LDA   HOOM
-0 10 00573      JST*  STBZ      SET THE HOOF TLST BUSY
            *    255
 0 02 00510      LDA   HOAD      HOO TLST DISK ADDR.
-0 10 00550      JST*  I$RL      INIT A READ LIST OF HOO
 000001          DEC   1         BEGIN ITEM NO.
 0 000522        DAC   BUF1      ADDR. OF BUFFER ADDR.
 0 000466        DAC   E325      ADDR. OF DISK ERROR ROUTINE
 101000          NOP             NO DATA RETURN
            *    300
 0 02 00510      LDA   HOAD      HOO TLST DISK ADDR.
-0 10 00551      JST*  I$WL      INIT A WRITE LIST OF HOO
 000001          DEC   1         BEGIN ITEM NO.
 0 000523        DAC   BUF2      ADDR OF BUFFER ADDR
 0 000505        DAC   325       ADDR OF DISK ERROR ROUTINE
 101000          NOP             NO DATA RETURN
            *
            *    305
-0 35 00565 CM50 LDX*  P$RL      TLST ITEM ADDR.
 1 02 00003      LDA   3,1       TLST DISK ID
 0 03 00616      AMA   -137777   CLEAR THE AXLE COUNT
-0 11 00533      CAS*  BFXA      TEST FOR CCT ITEM ID MATCH
 100000          SKP             NO
 0 01 00060      JMP   CM55      YES
            *    310
-0 10 00545      JST*  G$RL      NO---GET NEXT HOO ITEM
 0 01 00152      JMP   CM75      --END OF DATA
 0 01 00047      JMP   CM50      GO TEST NEXT ITEM
            *
            *    323
-0 10 00571 CM55 JST*  SCAT      SAVE THE TLST ITEM FOR TCHF AND HFD UPDATE
 177767          DEC   -9
```

```
-0 000000          XAC*  PARL
 0 000000          XAC   BFXA
            *
-0 02 00554        LDA*  MOUE     TEST IF TRIM MODE
 0404 76           LGR   2
 101100            SLN
 0 01 00152        JMP   CM75     NO---UPDATE TCHF AND HFD ONLY
            *
 0 12 00513        IRS   RICD     SET REVERSE ICD FLAG
            *
-0 02 00576        LDA*  T1PF     TRIM 1ST PASS FLAG
 100040            SZE            TEST IF FIRT PASS
 0 01 00101        JMP   *+6      NO
            *
-0 04 00561        STA*  QETY
-0 04 00560        STA*  NETY
-0 04 00563        STA*  OLNO
-0 04 00557        STA*  NLNO
-0 12 --576        IRS*  T1PF     SET TRIM FIRST PASS FLAG
            *
            *
 0 02 00533        LDA   BFXA     OVL-A 20 WORD DATA BUFFER
-0 10 00534        JST*  CTOB     CONVERT NEW CLASS TO BOWL
            *
            *      315
-0 02 00552        LDA*  L$RL     ITEM NO.
 0 04 00514        STA   XLRL     SAVE FOR DELETION
            *      320
 0 02 00533        LDA   BFXA
-0 10 00556        JST*  M$WL     MOVE & GIVE THE ITEM TO HOO
 0 01 00472        JMP   E327     --TLST FULL
            *      325
-0 02 00553        LDA*  L$WL
 0 07 00615        SUB   =1
-0 05 00552        ERA*  L$RL     TEST IF FOUND ITEM IS THE 1ST RL ITEM
 101040            SNZ
 0 01 00124        JMP   CM60     YES
            *      330
 0 02 00510        LDA   HOAD     NO
-0 10 00550        JST*  I$RL     INIT AN RL OF THE HOO TLST
 000001            DEC   1        BEGIN LINE NO
 0 000522          DAC   BUF1     ADDR. OF BUFFER ADDR.
 0 000466          DAC   E325     ADDR. OF DISK ERROR ROUTINE
 0 01 00466        JMP   E325     -NO TLST DATA RETURN
 0 01 00126        JMP   CM65
            *      335
-0 10 00545 CM60   JST*  G$RL     GET THE NEXT HOO ITEM
 0 01 00143        JMP   CM70     --END OF DATA
            *      340
 0 02 00514 CM65   LDA   XLRL
-0 05 00552        ERA*  L$RL     TEST IF THIS RL ITEM
 101040            SNZ            -HAS BEEN GIVEN TO WL
 0 01 00124        JMP   CM60     YES--GO GET NEXT RL ITEM
            *
            *      400
-0 35 00565        LDX*  P$RL     TEST FOR ZERO TLST ITEM
 1 02 00000        LDA   0,1
 101040            SNZ
 0 01 00124        JMP   CM60     YES--GO GET NEXT RL ITEM
            *      410
-0 10 00600        JST*  U$WL     MOVE AND GIVE THE RL ITEM TO WL
 0 01 00152        JMP   CM75     WL FULL, RL END OF DATA RETURN
 0 01 00472        JMP   E327     WL FULL RETURN
 0 01 00143        JMP   CM70     RL END OF DATA RETURN
 0 01 00126        JMP   CM65     --NORMAL RETURN
            *      415
-0 10 00543 CM70   JST*  E$WL     END THE WL FUNCT.
            *      420
            *
-0 02 00560        LDA*  NETY
 0 06 00614        ADD   =2
 0 11 00613        CAS   -13
 0 01 00152        JMP   CM75
 101000            NOP
```

```
-0 04 00560        STA*  NETY
                 *
                 *    422
                 **
 001001          CM75 INH
                 **
                 *    425
 0 02 00575      CM78 LDA   TCHF     BEGINNING TCHF ADDRESS
 0 06 00612           ADD   =98
 0 04 00524           STA   FRAD     CALC THE FROM AND
 0 04 00000           STA   '0
 0 06 00611           ADD   =9       TO PUSH DOWN ADDR
 0 04 00526           STA   TOAD
 1 02 00010           LDA   8,1
 100100               SLZ            TEST IF LAST ITEM KACI IS SET
 0 12 00511           IRS   LACI
                 *
-0 02 00524      CM80 LDA*  FRAD     PUHS DOWN 1 TCHF ITEM
-0 04 00526           STA*  TOAD
                 *
 0 02 00524           LDA   FRAD     DECR. THE
 0 07 00615           SUB   =1
 0 04 00524           STA   FRAD     FROM
 0 06 00611           ADD   =9       AND
 0 04 00526           STA   TOAD     TO ADDR.S
                 *
 0 12 00516           IRS   LOOP     TEST PUSH DOWN COMP
 0 01 00164           JMP   CM80
 0 12 00521           IRS   FRAD
                 *    430
-0 10 00571           JST*  SCAT     MOVE THE TLST ITEM TO THE TCHF
 177767               DEC   -9
 0 000000             XAC   BFXA
 0 000000             XAC   TCHF
                 *
 0 35 00575           LDX TCHF
 1 02 00005           LDA   5,1      TCHF ITEM SWING BIT
 100400               SPL            TEST IF CAR SWUNG
 0 01 00230           JMP   CM83     YES--TAGGED CCC CHECK NOT REQUIRED
                 *
 1 02 00004           LDA   4,1      TCHF ITEM BB/CCC
 0 03 00610           ANA   ='1777   CLEAR BITS 1-6
 0 04 00506           STA   CCC      SAVE THE CLASS CODE
 0 35 00607           LDX   =-20
-1 02 00577      CM81 LDA*  TTCE,1   GET A TAGGED CLASS CODE ENTRY
 0 03 00610           ANA   ='1777   CLEAR BITS 1-6
 0 05 00506           ERA   CCC      TEST FOR CCC MATCH
 101040               SNZ
 0 01 00222           JMP   CM82     YES
 0 12 00000           IRS   '0       NO---INCR. TTCE X
 0 01 00212           JMP   CM81     --ANOTHER ITEM
 0 01 00230           JMP   CM83     NO MATCH--CONTINUE PROCESSING
                 *
-1 02 00577      CM82 LDA*  TTCE,1   GET THE TAGGED CLASS CODE ROUTING
 0 35 00575           LDX   TCHF     RESTORE THE TCHF INDEX
 1 04 00004           STA   4,1      UPDATE THE TCHF ITEM
                 *
 1 02 00005           LDA   5,1
 140500               SSM            SET THE TCHF ITEM SWING BIT
 1 04 00005           STA   5,1
                 *
-0 02 00560      CM83 LDA*  NETY
 0 07 00615           SUB   =1
 101400               SMI            DECR THE NEWEST TCHF ENTRY POINTER
-0 04 00560           STA*  NETY
                 *
-0 02 00561           LDA*  CETY
-0 11 00547           CAS*  HLC      IS THE LAST HOO ITEM IN TCHF
 0 01 00240           JMP   *+2      NO
 0 01 00242           JMP   *+3      YES
 0 07 00615           SUB   =1       NO--DECR. THE OLDEST THCF ENTRY POINTER
 101400               SMI
-0 04 00561           STA*  QETY
                 *
                 *    435
```

```
 0 35 00575        LDX   TCHF
 1 02 00007        LDA   7,1
 0 03 00606        ANA   ='140000 CLEAR THE STATION NO.
 141206            AOA            AND SET KACI
 1 04 00007        STA   7,1
             *     440
 0 02 00511        LDA   LACI     TEST IF TCHF WAS FULL
 101040            SNZ
-0 12 00564        IRS*  OACI     NO---BUMP THE OLD ACI CNTR.
             *     450
             **
 000401            ENB            ENABLE INTERRUPTS
 0 01 00255        JMP   *+1
             **
             *     455
 0 02 00522        LDA   BUF1
-0 10 00541        JST*  DBZF     RELEASE THE 1ST 512 WORD BUFFER
             *
 0 02 00523        LDA   BUF2
-0 10 00541        JST*  DBZF     RELEASE THE 2ND 512 WORD BUFFER
             *     460
 0 02 00507        LDA   HOOM     HOO TRACK NAME
-0 10 00567        JST*  RTBZ     SET HOO TLST NOT BUSY
             *
             *
-0 02 00542        LDA*  DFLG
 101040            SNZ            TEST IF HFD BUSY
 0 01 00270        JMP   *+3      NO
-0 10 00530        JST*  B110     YES--RESCHEDULE HFD BUSY CHECK
 0 000263          DAC   *-4
             *
-0 12 00542        IRS*  DFLG     SET THE HFD BUSY FLAG
             *
             *     500
             *     505
-0 02 00574        LDA*  TAIL     TEST HFD FOR TOP OF SCREEN
-0 11 00527        CAS*  ADDR
 0 01 00327        JMP   CM95     NO--GO BUILD DISPLAY LINE
 101000            NOP            YES--PUSH DOWN HFD
-0 05 00546        ERA*  HEAD
 100040            SZE            ARE ANY LINES ON THE SCREEN
 0 01 00304        JMP   *+5      YES--GO PUSH DOWN
-0 02 00546        LDA*  HEAD     NO
 0 06 00605        ADD   =20      UPDATE THE HEAD POINTER
-0 04 00546        STA*  HEAD
 0 01 00336        JMP   C100
             *
             *     510
-0 02 00546        LDA*  HEAD
 0 07 00615        SUB   =1       CALC THE
 0 04 00524        STA   FRAD     FROM
 0 06 00605        ADD   =2-      AND
 0 04 00526        STA   TOAD     TO ADDR.S FOR
 141206            AOA            HFD PUSH DOWN
-0 04 00546        STA*  HEAD     UPDATE THE TAIL POINTER
             *
-0 02 00524 CM85   LDA*  FRAD     PUSH DOWN 1 HFD WORD
-0 04 00526        STA*  TOAD
             *
 0 02 00524        LDA   FRAD
 0 07 00615        SUB   =1
 0 04 00524        STA   FRAD
-0 11 00574        CAS*  TAIL     TEST IF HFD PUSH DOWN COMPLETE
 0 01 00324        JMP   CM90     NO
 0 01 00324        JMP   CM90     NO
 0 01 00336        JMP   C100     YES--GO BUILD DISPLAY LINE
             *
 0 06 00605 CM90   ADD   =20      CALC THE TO ADDR.
 0 04 00526        STA   TOAD
 0 01 00313        JMP   CM85     GO PUSH DOWN MFD
             *     520
-0 02 00574 CM95   LDA*  TAIL
 0 07 00605        SUB   =20      DECR THE TAIL ADDR
-0 04 00574        STA*  TAIL
             *
```

```
 0 04 00335        STA   *+3
 0 02 00507        LDA   =-20     NEG. NO OF WORDS TO BLANK
-0 10 00544        JST*  FBLK     BLANK THE DISP. LINE
 0 00 00000        ***   **
            *
            *      530
-0 02 00574 C100   LDA*  TAIL
 141206            AOA            CALC THE STORE ADDR FOR BINA
 140500            SSM
 0 04 00347        STA   C105
            *
-0 02 00563        LDA*  OLNO
 0 07 00615        SUB   =1       DECR THE OLDEST DISPLAY LINE NO.
 101400            SMI
-0 13 00563        IMA*  OLNO
            *
-0 10 00532        JST*  BINA     CONV. THE LINE NO. TO ASCII
 0 00 00000 C105   ***   **
 177775            DEC   -3
            *
-0 02 00574        LDA*  TAIL     CALC. DISPLAY ADDR.S FOR
 0 06 00604        ADD   =3
 0 04 00365        STA   C110     CRIN.
 0 06 00603        ADD   =6
 0 04 00525        STA   STAD     SWING *
 141206            AOA
 0 04 00372        STA   C115     CCC
 0 06 00614        ADD   =2
 140500            SSM
 0 04 00377        STA   C120     BB
            *
-0 10 00536        JST*  CRIN     CONV. THE CAR I-N TO ASCII
 0 000000          XAC   TCHF
 0 00 00000 C110   ***   **
            *
 0 35 00575        LDX   TCHF
 1 02  00004       LDA   4,1      GET THE CCC/BB
 0 03 00610        ANA   ='1777   CLEAR BITS 1-6
            *
-0 10 00532        JST*  BINA     CONV. THE CLASS CODE TO ASCII
 0 00 00000 C115   ***   **
 177775            DEC   -3
            *
 1 02 00004        LDA   4,1      GET THE CCC/BB
 0404 66           LGR   10       RIGHT JUST. THE BOWL TRACK
-0 10 00532        JST*  BINA     CONV. THE BOWL TRACK TO ASCII
 0 00 00000 C120   ***   **
 177776            DEC   -2
            *
 1 02 00005        LDA   5,1      GET THE SWING BIT/SA CODE
 101400            SMI            TEST IF CAR SWUNG
 0 01 00410        JMP   *+5      NO
-0 02 00525        LDA*  STAD     YES
 141050            CAL            FLAG THE DISPLAY ENTRY
 0 05 00505        ERA   ASTX     WITH AN ASTERISK
-0 04 00525        STA*  STAD
            *
 1 02 00005        LDA   5,1      GET THE SA CODE
 0416 73           ALR   5        SHIFT TO BITS 13-16
 0 03 00602        ANA   ='17     CLEAR BITS 1-12
 0 04 00000        STA   '0       SAVE AS X TO SA TABLE
-1 02 00570        LDA*  SARC,1   GET THE SA CODE MNEM
-0 35 00574        LDX*  TAIL     BEGIN DISPLAY LINE ADDR.
 1 04 00016        STA   14,1     GIVE THE SA CODE TO THE DISPLAY LINE
            *
 0 35 00575        LDX   TCHF
 1 02 00006        LDA   6,1      GET THE SH CODE
 141140            ICL            RIGHT JUST
 0 03 00602        ANA   ='17     CLEAR BITS 1-12
 0 04 00000        STA   '0       SAVE AS X TO SH TABLE
-0 02 00572        LDA*  SHRC     GET THE SH CODE MNEM
-0 35 00574        LDX*  TAIL     BEGINNING DISPLAY LINE ADDRESS
 1 04 00020        STA   16,1
            *
```

```
 0 02 00513        LDA   RICD     REVERSE ICD FLAG
 101040            SNZ            TEST IF SET
 0 01 00455        JMP   C125-2   NO---GO RESET HFD BUSY FLAGE & O/P HFD
                 *
-0 12 00557        IRS*  NLNO
 0 02 00347        LDA   C105     ADDR OF 1ST HFD ITEM LINE NO
 0 04 00437        STA   *+3      SAVE FOR PULL BACO LINE NO CONV.
                 *
 0 02 00512        LDA   LNNO
-0 10 00532        JST*  BINA     CONV A LINE NO TO ASCII
 0 00 00000 TAG    ***   **
 177775            DEC   -3
                 *
 0 02 00437        LDA   TAG
 140100            SSP
 0 06 00605        ADD   =20      BUMP ADDR TO NEXT DISP LINE NO
 0 04 00000        STA   '0
 140500            SSM
 0 04 00437        STA   TAG
-0 02 00000        LDA*  '0
 0 05 00601        ERA   ='120240 TEST FOR END OF HFD
 101040            SNZ
 0 01 00455        JMP   *+3      YES
 0 12 00512        IRS   LNNO
 0 01 00435        JMP   TAG-2
                 *
 140040            CRA
-0 04 00542        STA*  DFLG     RESET THE DISPLAY BUSY FLAG
                 *
                 *  535
-0 02 00562 C125   LDA*  OOBF     GET A DEVICE NO
 101040            SNZ            ANOTHER DEVICE NO TO O/P
 0 01 00465        JMP   0130     NO
-0 10 00535        JST*  COMF     QUEUE THE HFD FOR O/P
 0 12 00562        IRS   OOBF
 0 01 00457        JMP   C125     NO
                 *  550
-0 01 00531 C130   JMP*  B10A     YES--RETURN CONTROL TO THE EXEC--RELEASE OVL-A
                    EJCT
                 *  600
 0 35 00517 E325   LDX   P325     DISK ACCESS ERROR
 0 01 00473        JMP   E327+1
                 *  610
 0 35 00520 E326   LDX   P326     CAR NOT FOUND IN HOO
 0 01 00473        JMP   E327+1
                 *  620
 0 35 00521 E327   LDX   P327     HOO TLST CAPACITY EXCEEDED
                 *
                 *  625
 0 02 00522        LDA   BUF1
-0 10 00541        JST*  DBZF     RELEASE THE 1ST 512 WD. BUFFER
                 *  630
 0 02 00523        LDA   BUF2
-0 10 00541        JST*  DBZF     RELEASE THE 2ND 512 WD. BUFFER
                 *
 0 02 00507        LDA   HOOM
-0 10 00567        JST*  RTBZ     SET THE HOO TLST NOT BUSY
                 *  640
 0 02 00000        LDA   '0       ERROR CODE
 0 35 00515        LDX   DVNO     DEVICE NO.
-0 10 00555        JST*  MER1     QUEUE TEH ERROR CODE FOR OUTPUT
                 *  645
-0 01 00531        JMP*  B10A     RELEASE OVL-B AND RETURN CONTROL TO THE EXEC.
                 *
                    EJCT
                    *
                    *
 125000      ASTX  OCT   125000
 000000      CCC   OCT   0
 144000      HOOM  OCT   144000
 102312      HOAD  OCT   102312
 000000      LACI  OCT   0
 000001      LNNO  OCT   1
```

```
                * PROGRAM NAME  -  BI-DIRECTIONAL TRACKING
000000          RICD OCT   0
000000          XLRL OCT   0
                *
                *
000012          DVNO DEC   10
177635          LOOP DEC   -99
000505          P325 DEC   325
000500          P326 DEC   326
000507          P327 DEC   327
                *
                *
0 000000        BUF1 DAC   **
0 000000        BUF2 DAC   **
0 000000        FRAD DAC   **
0 000000        STAD DAC   **
0 000000        TOAD DAC   **
                *
                *
0 000000        ADDR XAC   ADDR
0 000000        B110 XAC   B110
0 000000        B10A XAC   B10A
0 000000        BINA XAC   BINA
0 000000        BFXA XAC   BFXA
0 000000        CTOB XAC   CTOB
0 000000        COHF XAC   COHF
0 000000        CRIN XAC   CRIN
0 000000        CTBZ XAC   CTBZ
0 000000        CK5  XAC   CK5
0 000000        DBZF XAC   DBZF
0 000000        DFLG XAC   DFLG
0 000000        E$WL XAC   EAWL
0 000000        FBLK XAC   FBLK
0 000000        G$RL XAC   GARL
0 000000        HEAD XAC   HEAD
0 000000        HLC  XAC   HLC
0 000000        I$RL XAC   IARL
0 000000        I$WL XAC   IAWL
0 000000        L$RL XAC   LARL
0 000000        L$WL XAC   LAWL
0 000000        MODE XAC   MODE
0 000000        MER1 XAC   MER1
0 000000        M$WL XAC   MAWL
0 000000        NLNO XAC   NLNO
0 000000        NETY XAC   NETY
0 000000        CETY XAC   CETY
0 000000        ODBF XAC   ODBF
0 000000        OLNO XAC   OLNO
0 000000        CACI XAC   CACI
0 000000        P$RL XAC   PARL
0 000000        P$WL XAC   PAWL
0 000000        RTBZ XAC   RTBZ
0 000000        SARC XAC   SARC
0 000000        SCAT XAC   SCAT
0 000000        SHRC XAC   SHRC
0 000000        STBZ XAC   STBZ
0 000000        TAIL XAC   TAIL
0 000000        TCHF XAC   TCHF
0 000000        T1PF XAC   T1PF
0 000000        TTCE XAC   TTCE
0 000000        U$WL XAC   UAWL
                *
120240                FIN
000017
000006
000003
000024
140000
177754
001777
000011
000142
000015
000002
```

```
000001
037777
          *
                    ORG   '777
000027              DEC   23
                    END
0 00 00000 BDTK     PZE
0 02 00144          LDA   5P
0 04 00157          STA   TCWD     UPDATE DEBUG TRACE WORD
-0 10 00236         JST*  KBIT     INCREMENT WDCT WHEEL DETECTOR COUNTS
0 000000            XAC   TPIW
000001              DEC   1
000057              DEC   47
-0 01 00241         JMP*  RBIT     0-RETURN TO KBIT
0 01 07071          JMP   BD05     1-EAST TO WEST HIT
          *
-0 10 00236         JST*  KBIT
0 000000            XAC   TP04
000001              DEC   1
000057              DEC   47
-0 01 00241         JMP*  RBIT     0-RETURN TO KBIT
0 01 07073          JMP   BD06     1-WEST TO EAST HIT
0 02 00161          LDA   MODE
0 03 07110          ANA   13P
101040              SNZ
0 01 07077          JMP   BD08
0 35 00147          LDX   3N
-1 02 07723 BD02    LDA*  TL14,1
-1 05 07725         ERA*  TPT4,1
0 04 07031          STA   *+3
-1 02 07102         LDA*  TWDW,1   WEST TO EAST
-0 10 00215         JST*  ORA
0 00 00000          PZE
0 04 07035          STA   *+3
-1 02 07101         LDA*  TWDE,1   EAST TO WEST
-0 10 00215         JST*  ORA
0 00 00000          PZE
1 04 07110          STA   TKCG+3,1
0 12 00000          IRS   0
0 01 07024          JMP   BD02
-0 10 00236         JST*  KBIT     TEST BIT STRING
0 007105            DAC   TKCG
000001              OCT   1
000057              DEC   47
-0 01 00241         JMP*  RBIT
0 01 07132          JMP   BD01
0 02 00147          LDA   3N
0 04 00771          STA   TMP1
0 35 00143          LDX   OP
-1 02 07722 BD81    LDA*  TL11,1
-1 04 07726         STA*  TPTK,1
-1 02 07103         LDA*  T13A,1
000201              IAB
-1 02 07104         LDA*  T12A,1
0410 70             LLL   8
0 04 07063          STA   *+3
-1 02 07720         LDA*  TBAC,1
-0 10 00215         JST*  ORA
0 00 00000          PZE
-1 04 07724         STA*  T007,1
0 12 00000          IRS   0
0 12 00771          IRS   TMP1
0 01 07052          JMP   BD81
-0 01 07730         JMP*  BICB
          *
0 02 00142 BD05     LDA   1N
100000              SKP
0 02 00123 BD06     LDA   1P
-1 06 07100         ADD*  BDWD,1
-1 04 07100         STA*  BDWD,1   UPDATE WD COUNT
-0 01 00241         JMP*  RBIT     RETURN TO KBIT
-0 01 07000 BD08    JMP*  BDTK     EXIT BDTK
0 000000   BDWD     XAC   BDWD     BI-DIRECTIONAL WHEEL DETECTOR COUNTERS
0 000000   TWDE     XAC   TP04
```

```
 0 000000    TWDW XAC   TP07
 0 000000    T13A XAC   T13A
 0 000000    T12A XAC   T12A
 000000      TKCG BSZ   3
 000000
 000000
 000015      13P  DEC   13
 000000      BDSB OCT   0
             *
 0 02 00000  BD86 LDA   0
-0 10 00225       JST*  BIT0
 0 000000         XAC   ET0
             *
 140040      BD03 CRA
-0 10 07705       JST*  SBAC
-0 10 07715       JST*  SVSW
-0 10 07711       JST*  SNXX
 0 02 00000       LDA   0
-0 10 00225       JST*  BIT0
 0 000000         XAC   SWLX
-0 10 00225       JST*  BIT0
 0 000000         XAC   ESME
 0 02 07111  BD04 LDA   BDSB
 000201           IAB
 0 35 00164       LDX   K
-0 01 00241       JMP*  RBIT
 000201      BD01 IAB
 0 04 07111       STA   BDSB
 0 02 00000       LDA   0
 0 04 00164       STA   K
-0 10 00253       JST*  TEIP
 100000           SKP
 0 01 07115       JMP   BD03    THIS ZONE IP
-0 10 07717       JST*  T200
 100000           SKP
 0 01 07115       JMP   BD03    TRACKING FAILURE ALARM IS SET
-0 10 00247       JST*  RETK    IS NEW TRACK CKT = OLD
 0 04 00771       STA   TMP1    TMP1 RESIDES IN SECTOR ZERO
-0 10 07703       JST*  RPTK
 0 11 00771       CAS   TMP1
 0 01 07302       JMP   BD14    NO
 0 01 07153       JMP   *+2     YES
 0 01 07302       JMP   BD14    NO
             *
-0 10 07701       JST*  REWD    HAS WHEEL DETECTOR HIT
 101040           SNZ
 0 01 07126       JMP   BD04    NO
             *                  YES
 0 11 00124       CAS   3P      IS THIS A VALID INPUT
 0 01 07161       JMP   *+2
 0 01 07165       JMP   BD15    YES
             *                  NO
-0 10 00247       JST*  RETK    IS TK CKT OCCUPIED
 100040           SZE
 0 01 07170       JMP   BD16    YES
 0 01 07415       JMP   BD55
-0 10 07667  BD15 JST*  A400    SET OVERCOUNT ALARM
-0 10 07665  BD53 JST*  A200
 0 01 07115       JMP   BD03
 007170      BD16 EQU   *
             *
-0 10 07677       JST*  RBAC    IS AXLE COUNT = 0
 100040           SZE
 0 01 07202       JMP   BD17    NO
             *                  YES
 0 02 00123       LDA   1P
-0 10 07705       JST*  SBAC    SET AXLE COUNT
-0 10 07701       JST*  REWD
-0 10 07710       JST*  SEDE    SET OLD DIRECTION AT WD(K)
-0 10 00246       JST*  RESW    READ DIOS SWITCH POSITION
-0 10 07715       JST*  SVSW    SET BDTK SWITCH POSITION
 0 01 07126       JMP   BD04
             *
             *
```

```
140040      BD17 CRA            INITIALIZE BY ASSUMING
 0 04 00173      STA   MV      A CREST END MOVE
 0 02 00142      LDA   1N
 0 04 00175      STA   BE
            *
-0 10 07701      JST*  REWD
 0 04 00772      STA   TMP2
-0 10 07700      JST*  REDE    WAS THERE
 0 07 00772      SUB   TMP2    A CHANGE
100040           SZE           OF DIRECTION AT THIS WD
 0 01 07251      JMP   BD18    YES
-0 10 07677      JST*  RBAC    INCREMENT AXLE COUNT
141206           AOA
-0 10 07705      JST*  SBAC
            *
 0 11 00122      CAS   2P      IS AXLE COUNT = 2
 0 01 07222      JMP   *+2
 0 01 07240      JMP   BDAA
 0 04 00772      STA   TMP2
            *                  NO
-0 10 07702      JST*  RNXX    IS BAC(K) = NXX(K) /2
0400 77          LRL   1
 0 11 00772      CAS   TMP2
 0 01 07230      JMP   *+2
 0 01 07246      JMP   BD19    YES
            *
0410 77          LLL   1       IS NXX(K) GE BAC(K)
 0 11 00772      CAS   TMP2
 0 01 07126      JMP   BD04
 0 01 07235      JMP   *+2
 0 01 07126      JMP   BD04    NO GO LOOK AT NEXT ZONE
            *
 0 02 00123 BD20 LDA   1P      NOTE A MOVE IS REQUIRED
 0 04 00173      STA   MV
 0 01 07355      JMP   BD21
-0 10 07704 BDAA JST*  RVSW
 0 11 00143      CAS   OP
 0 11 00124      CAS   3P
101000           NOP
 0 01 07367      JMP   BD59
-0 10 07715      JST*  SVSW
 0 02 00123 BD19 LDA   1P      A BOWL END MOVE IS ASSUMED
 0 04 00175      STA   BE
 0 01 07235      JMP   BD20
            *
 0 02 00123 BD18 LDA   1P
 0 04 00175      STA   BE
            *    IS BAC K  KE 1
-0 10 07677      JST*  RBAC
 0 04 00772      STA   TMP2
 0 07 00122      SUB   2P
100400           SPL
 0 01 07113      JMP   BD03
-0 10 07702      JST*  RNXX
0400 77          LRL   1
 0 11 00772      CAS   TMP2    IS BAC(K) LT NXX(K)/2
 0 01 07273      JMP   BD24    YES ASSUME A CREST END
            *
101000           NOP           NO
141206           AOA
 0 11 00772      CAS   TMP2    IS BAC(K) GT NXX(K) 2+1
101000           NOP           NO
 0 01 07275      JMP   BD23    NO
            *                  YES
 0 02 00142      LDA   1N
 0 04 00175      STA   BE
            *
 0 02 00123 BD24 LDA   1P      POST MOVE INTENDED
 0 04 00173      STA   MV
            *
-0 10 07702 BD23 JST*  RNXX
141206           AOA           DIRECTION REVERSAL
 0 07 00772      SUB   TMP2
-0 10 07705      JST*  SBAC
 0 01 07355      JMP   BD21
```

```
-0 10 07701 BD14 JST*  REWD    IS WD(K) = 0
 100040          SZE
 0 01 07306      JMP   BD25
 0 01 07310      JMP   BD99
-0 10 07667 BD25 JST*  A400    SET A WHEEL DETECTOR OVERCOUNT ALARM
 0 01 07126      JMP   BD04
            *                  YES
            *
-0 10 07677 BD99 JST*  RBAC
 101040          SNZ
 0 01 07327      JMP   BD77    YES
            *
 0 04 00772      STA   TMP2
-0 10 07702      JST*  RNXX    IS BAC(K) EG NXX(K)
 0400 77         LRL   1
 0 11 00772      CAS   TMP2
 0 01 07321      JMP   *+2     NO
 0 01 07126      JMP   BD04    YES
            *                  NO
-0 10 00247      JST*  RETK    IS ET(K) OCCUPIED
 100040          SZE
 0 01 07126      JMP   BD04    YES
            *                  NO
 140040          CRA
 0 04 00173      STA   MV
 0 01 07371      JMP   BD97
-0 10 00247 BD77 JST*  RETK    IS TRK CKT OCCUPIED
 101040          SNZ
 0 01 07112      JMP   BD86    NO
 0 02 00000      LDA   0       YES
-0 10 00222      JST*  TBIT
 0 000000        XAC   SWLK
 140040          CRA           ZERO
 100040          SZE
 0 02 00123      LDA   1P
-0 10 07706      JST*  SBIT
 0 000000        XAC   SWLX
 0 02 00000      LDA   0
-0 10 00222      JST*  TBIT
 0 000000        XAC   TL23    TEST SW IN MANUAL
 140040          CRA           MAN
 100040          SZE
 0 02 00123      LDA   1P
 140401          CAM
 0 03 00123      ANA   1P
-0 10 07706      JST*  SBIT
 0 000000        XAC   ESME
 0 01 07126      JMP   BD04
 140040     BD21 CRA           RESET ECC
 0 04 07656      STA   ECC
            *    SH,2
 0 02 00173      LDA   MV
 101040          SNZ
 0 01 07417      JMP   BD68
-0 01 07727      JMP*  CBBC
            *
 0 02 00301 BD36 LDA   CX
 101040          SNZ
 0 01 07115      JMP   BD03
 0 01 07417      JMP   BD68
            *
-0 10 07664 BD59 JST*  A100
 0 01 07166      JMP   BD53
            *
            *
            *    SH,1
 0 02 00000 BD97 LDA   0
-0 10 00225      JST*  BITO
 0 000000        XAC   ETO
 0 35 00164      LDX   K
-0 10 07677      JST*  RBAC    IS AXLE COUNT
 0 11 00123      JMP   *+2     WHEN TK CKT WENT UNOCCUPIED
 0 01 07415      JMP   BD55    YES
            *                  NO
```

```
 0 04 00771        STA   TMP1     WAS AXLE COUNT
-0 10 07702        JST*  RNXX     EQUAL TO ONE LESS THAN EXPECTED
 0 07 00123        SUB   1P
 0 07 00771        SUB   TMP1
 100040            SZE
 0 01 07166        JMP   BD53     NO THIS DETECTION POINT HAS FAILED
            *                     YES
-0 10 0770         JST*  REDE     ASSUME AN
-0 10 07675        JST*  DUAL     UNDER COUNT AND
 0 000000          XAC   TPIW     SIMULATE EAST TO WEST BIT WHEEL DETECTOR INPUT
 0 000000          XAC   TP04     WEST TO EAST
            *
-0 10 07666        JST*  A300
 0 01 07170        JMP   BD16
-0 10 07667 BD55   JST*  A400
 0 01 07115        JMP   BD03
            *      SH,2
 0 35 00164 BD68   LDX   K        UPDATE
-0 10 07701        JST*  REWD     PAST DIRECTION
-0 10 07710        JST*  SEDE
            *
 0 02 00173        LDA   MV       WAS A MOVE INTENDED
 101040            SNZ
 0 01 07126        JMP   BD04     NO
            *                     YES
-0 10 07702        JST*  RNXX     HAS EXPECTED AXLE COUNT BEEN DETERMINED
 100040            SZE
 0 01 07440        JMP   BD73
            *                     NO
 0 35 00301        LDX   CX       RECORD NUMBER OF AXLES EXPECTED
-0 10 00231        JST*  RDAX
 0 35 00164        LDX   K
-0 10 00226        JST*  DNAX
-0 10 07711        JST*  SNXX
 0 11 00121        CAS   4P
 0 01 07126        JMP   BD04
 101000            NOP
            *                     DO MOVE 4 AXLE CAR ON 2ND AXLE
 0 02 00165 BD73   LDA   CTB      IF THIS IS A REVERSE
 100400            SPL            MOVEMENT, MOVE WILL BE INTO
 0 01 07634        JMP   BD57     ZONE K
-0 10 07704        JST*  RVSW
 0 11 00122        CAS   2P
 0 01 07367        JMP   BD59     SWITCH POS ERROR
 0 01 07451        JMP   BD60
-0 10 00250        JST*  RZ
 0 01 07452        JMP   BD61
-0 10 00240 BD60   JST*  NZ
 0 04 00170 BD61   STA   KX
-0 10 00251 BD62   JST*  SEQN
-0 10 00230        JST*  MDCK     HUMPING MODE
 0 01 07464        JMP   BD63     NO
            *                     YES
 0 02 00165        LDA   CTB
 101400            SMI
 0 01 07464        JMP   BD63
            *
 0 35 00301        LDX   CX       MARK THE CAR IN QUESTION
            *                     ZERO STALL TIMERS IN CCT MEAN CAR HAS STALLED
 140040            CRA
-1 04 07674        STA*  CXTN,1
            *
 0 02 00175 BD63   LDA   BE       IS THIS A BOWL END
 101400            SMI
 0 01 07601        JMP   BD64     YES
            *
-0 10 00230        JST*  MDCK     HUMPING MODE
 0 01 07644        JMP   B65A
            *                     YES
 0 02 00165        LDA   CTB      IS THIS A
 100400            SPL            CREST TO BOWL NONE
 0 01 07572        JMP   BD65
            *
            *
            *
```

```
 0 35 00301        LDX   CX       CALCULATE LAST AXLE
-0 10 00244        JST*  RDL2
 101040            SNZ
 0 01 07640        JMP   BDLB
 0 04 00772        STA   TMP2
-0 10 00245        JST*  RDL3
 0 07 00772        SUB   TMP2
 100400            SPL
 0 01 07640        JMP   BDLB
 0404 77           LGR   1
 0 04 00772        STA   TMP2
-0 10 00244        JST*  RDL2
 0 06 00772        ADD   TMP2
 100040            SZE
 100400            SPL
 0 01 07640        JMP   BDLB
 0 04 00772        STA   TMP2
            *
-0 10 00243        JST*  RDL1
 0414 77           LGL   1
 0 04 07655        STA   LCUT
-0 10 00245        JST*  RDL3
 0 06 07655        ADD   LCUT
 0 04 07655        STA   LCUT
            *
-1 02 07674 BDLD   LDA*  CXTN,1   HAS
 101040            SNZ   THIS CAR STALLED
 0 01 07551        JMP   BD96
 0 02 00156        LDA   ST1      FIND TIME DIFFERENCE BETWEEN MOVING
-1 07 07674        SUB*  CXTN,1   CREST AND BOWL ENDS
            *                     IF THIS CAR IS GOING INTO A ZONE PAST THE LAST
            *                     SWITCH USE THE STALL TIMER FOR THE LAST SWITCHING
            *                     ZONE SINCE THERE ARE ONLY 47 TIM CONSTANTS
 000201            IAB
 0 02 00170        LDA   KX
 0 11 00154        CAS   LSZ
 0 02 00154        LDA   LSZ
 101000            NOP
 0 04 00000        STA   0
 000201            IAB
-1 06 07731        ADD*  STUP,1
 0 35 00301        LDX   CX
 100400            SPL
 0 01 07551        JMP   BD96
 0 04 00773        STA   TMP3     CALCULATE
 0 02 00772        LDA   TMP2     815 CONTAINS LENGTH IN VT LENGTH UNITS
 0401 66           LRS   10
-0 10 00233        JST*  DIV
 0 000773          DAC   TMP3     B10 VELOCITY LENGTH/ST1 COUNTS
 100000            SKP
 140040     BD96   CRA
-0 10 00252        JST*  SVEL     PLACE SWITCH LOCK VELOCITY IN CCT
            *
            *
-0 10 07670        JST*  ACRN     BD66 - UPDATE ANTI CORNERING
 0 02 00170        LDA   KX
 0 11 00154        CAS   LSZ
 0 01 07561        JMP   *+3
 101000            NOP
 0 01 07572        JMP   BD65
 0 35 00301        LDX   CX
 0 07 00154        SUB   LSZ
-0 10 07707        JST*  SECD
 0 04 00000        STA   0
            *
-1 02 00237        LDA*  LVFN,1
 0 07 07655        SUB   LCUT
 100400            SPL
 140040            CRA
-1 04 00237        STA*  LVFN,1
            *
 0 35 00301 BD65   LDX   CX
 0 02 00165        LDA   CTB      UPDATE CREST END
 0 06 00167        ADD   SQ1      ZONE AND SEQUENCE
-1 04 07672        STA*  CXCQ,1   NUMBER
```

```
 0 02 00170        LDA   KX        UPDAT CREST END
-0 10 07733        JST*  SECN      ZONE NUMBER
 0 01 97624        JMP   BD67      NO
            *      SH,3
 0 02 00165 BD64   LDA   CTB       CALCULATE A NEW
 0 06 00167        ADD   SQ1       SEQUENCE NUMBER
            *
 0 35 00301        LDX   CX        PLACE NEW BOWL END
-1 04 07671        STA*  CXBQ,1    ZONE
            *                      AND
 0 02 00170        LDA   KX        SEQUENCE NUMBERS IN
-0 10 07732        JST*  SEBN      CAR CONTROL TABLE
            *
 0 02 00170        LDA   KX
 0 11 00154        CAS   LSZ
 0 02 00154        LDA   LSZ
 101000            NOP
 0 04 00000        STA   0
 0 02 00156        LDA   ST1
-1 06 07731        ADD*  STOP,1
 0 35 00301        LDX   CX
-1 04 07674        STA*  CXTM,1    TO CURRENT TIME
-0 10 07676        JST*  MSRT
 0 02 00164        LDA   K
-0 10 00224        JST*  BIT1
 0 000000          XAC   ETO
            *
 0 35 00164 BD67   LDX   K
-0 10 07702        JST*  RNXX
 0 04 00776        STA   TMP6
-0 10 07677        JST*  RBAC
 0 07 00776        SUB   TMP6
 100040            SZE
 0 01 07126        JMP   BD04
 0 01 07115        JMP   BD03
            *
 0 02 00164 BD57   LDA   K
 0 04 00170        STA   KX
 0 01 07453        JMP   BD62
            *
-0 01 07730 B150   JMP*  BICB
 0 02 00115 BDLB   LDA   64P
 0 04 07655        STA   LCUT
 0 04 00772        STA   TMP2
 0 01 07523        JMP   BDLD
 0 02 00170 B65A   LDA   KX
 0 11 00154        CAS   LSZ
 0 01 07651        JMP   *+3
 101000            NOP
 0 01 07572        JMP   BD65
 0 07 00154        SUB   LSZ
 0 35 00301        LDX   CX
-0 10 07707        JST*  SECD
 0 01 07572        JMP   BD65
            *
 000000     LCUT   OCT   0         CUT LENGTH
 000000     ECC    OCT   0         ECC EQ 1 WHEN BOWL END ICD HAS OCCURRED
            *
 040370     FBM1   OCT   40370
 037407     FBMK   OCT   37407
                   END
```

Job assignments selected by the movement control center may be transmitted by the CPU to other type mobile work units in the terminal area. For example, mobile car inspector teams or car repair teams provided with truck transportation may be used and directed throughout the terminal area to perform the necessary work. The work list format under such conditions indicates the locations of the cars to be inspected or repaired and if possible the nature of the work to be done. Such work units report completion of each job item prior to moving to the next item on their work list. Obviously, however, no route controls are needed for this type of mobile work units and also no actual check by the CPU is possible as to the full and correct completion of the work list items. However, when such a team is working on cars anywhere in the yard, the CPU provides the necessary route blocking for safety purposes. That is, no switching locomotive will be routed into any track where the cars are being worked upon by inspectors or repair teams. This safety function will be performed automatically in accordance with the data already stored in the CPU as the work assignments are made and transmitted.

The system of my invention thus provides an efficient control of the movement of vehicles in a railroad terminal area. All movement of mobile work units is directed from a central location where all the operating data and information pertaining to the terminal is readily available. Not only movement of the mobile units is directed but the movement of cars through the terminal including the various yards is centrally controlled. The work units, particularly the switching locomotives, do not need to return for specific work assignments to a central location but may remain in position for subsequent operations. In addition, the work list formats transmitted to such locomotives and other work units, and recorded thereon, direct the best sequence of the operations for the utmost economy. Since central direction of operation is thus provided, fewer personnel and less items of equipment are needed to perform the work. The economy and efficiency thus obtained result in a better and cheaper operation of the railroad terminal using the arrangement disclosed.

Although I have herein shown and described only a single specific embodiment of the vehicle movement control system for railroad terminals of my invention, it is to be understood that various changes and modifications may be made therein within the scope of the appended claims without departing from the spirit and scope of my invention.

Having now described the invention what I claim as new and desire to secure by Letters Patent, is:

1. In a railroad terminal control system having a central control location, a digital computer central data processing means programmed to respond to the recording of a selected work assignment for developing from stored vehicle inventory data an itemized list of successive work steps necessary to complete that work assignment and further programmed to respond to the reception of a work list item completion report from a selected work unit for checking the correctness of the work item completed, and a plurality of mobile work units; the combination comprising, a. communication apparatus coupled for providing a data transmission channel between said control location, said central data processing means, and said mobile work units, b. movement control means at said control location operable for selecting a work assignment and connected for recording that assignment in said central data processing means, c. said central data processing means connected to said communication apparatus for transmitting the corresponding itemized work list to a selected mobile work unit, d. recording means at each mobile work unit connected to said communication apparatus for receiving and recording an itemized work list transmitted to that work unit, and e. information transmitting means at each work unit connected to said communication apparatus for successively reporting completion of each item of a recorded work list to said central data processing means, f. said central data processing means also connected for transmitting control signals to authorize said selected work unit to undertake the successive item on the recorded work list only when the reported work item was correctly completed.

2. A railroad terminal control system as defined in claim 1 in which said combination further comprises, a. control and information function transmitting apparatus connected for providing communication between said central data processing means remotely located field devices of said terminal control system, 1. said function transmitting apparatus controlled by said central data processing means for periodically transmitting control functions to selected ones of said field devices for establishing conditions necessary for said work units to complete work assignments, 2. said function transmitting apparatus further controlled by others of said field devices for reporting to said central data processing means information of the movements of work units in completing each item of work assignments, b. said central data processing means being responsive to information received from said other field devices for checking the correct completion of an item of a particular work list when the corresponding item-complete report is received from the corresponding work unit, c. said central data processing means being further responsive to each item-complete report from said corresponding work unit for actuating the transmission of control functions for establishing the necessary field conditions to perform the next item of said particular work list and an authorizing signal to said corresponding work unit to perform that next work list item only when the checks of the preceding item indicate correct completion.

3. A railroad terminal control system as defined in claim 2 in which, a. said function transmitting apparatus is further controlled by said selected ones of said field devices for reporting to said central processing means the establishment of the field conditions directed by each periodic transmission of control functions, and b. said central data processing means is also responsive to the field condition reports from said selected field devices for transmitting to said corresponding work unit said authorizing signal to perform the next work list item only when the necessary field conditions for that next item have also been established by said field devices.

4. In a railroad terminal control system including a central control location with a programmable data processing unit, a plurality of remote vehicle work units each capable of performing a selected type of work assignment, and a communication system connecting said control location, said vehicle units, and said data processing unit, a method for controlling the work movements of said vehicle work units comprising the steps of, a. entering a selected work assignment into said data processing unit, b. selected by said data processing unit in accordance with preregistered programmed instructions a particular remote vehicle unit and a work format to be performed thereby, to accomplish said selected work assignment, c. transmitting said work format to said particular vehicle unit over said communication system as an itemized work list, d. recording said transmitted work list on said particular vehicle unit, e. periodically transmitting from said data processing unit the necessary terminal condition controls and authority signals for successively performing items of said work list, f. authorizing said particular vehicle unit to perform in order the successive items of said work list when each corresponding authority signal is successively received, g. transmitting from said particular vehicle unit, alternately with each authority signal received, a signal to said data processing unit when each work list item is completed, and h. checking by said data processing unit in accordance with the preregistered programmed instructions and said selected work format, the correct completion of the preceding work list item prior to transmitting to said particular vehicle unit an authority signal for performing the next successive work list item.

5. The method of controlling the movement of vehicles in a railroad terminal control system as defined in claim 4, further comprising the additional steps of, a. transmitting an initial ready-to-work signal from said particular vehicle unit to said data processing unit after the recording of said itemized work list and prior to the transmission of an initial authority signal, b. transmitting in response to the reception of an initial ready-to-work signal and each work item completed signal from said particular vehicle, terminal condition control functions to prepare for performing the next item of the work list recorded on said particular vehicle only when the completion of that preceding item checks correct, and c. checking also the existence of proper terminal conditions for performing the next work list item recorded on said particular vehicle prior to transmitting a corresponding authority signal.

6. In a railroad terminal which includes a storage area for cars and a train assembly area, mobile work units for moving cars between the areas, a car movement control location with a car information data processing means programmed to respond to the input of a train assembly work assignment to develop an itemized work list, to respond to a work list item completion report received from a work unit for checking correctness of the work item as completed in accordance with the work assignment input and the stored car location data, and to respond to a work list to successively select command functions to establish track routes for the train assembly assignment; and a communication network connecting said control location and all said work units, a train assembly control system comprising, in combination, a. a readout means at said control location connected to said data processing means and operable for activating and displaying the readout of train details and existing car locations for a particular train to be assembled, b. decision input means associated with said readout means and connected also to said data processing means for activating the preparation and transmission of an itemized work list over said communication network to a selected work unit for accomplishing the assembly of that particular train when a corresponding work assignment decision is input.

c. printout means at each work unit connected to said data processing means by said communication network for selectively receiving and recording an itemized work list transmitted from said data processing means, d. transmission means at each work unit connected to said communication network for selectively reporting the completion of each item of a recorded work list to said data processing means, e. said data processing means coupled for transmitting signals to authorize that work unit to perform the next work item only when the reported previous item has been correctly completed.

7. A train assembly control system for railroad terminals as defined in claim 6, further comprising, a. wayside apparatus coupled for establishing track routes and detecting car movements, b. a control and indication function transmitting system connected to said wayside apparatus and controlled by said data processing means for transmitting control function commands to selected elements of said wayside apparatus to establish track routes for said work units to accomplish selected train assembly operations, c. said function transmitting system being further controlled by said wayside apparatus for reporting to said data processing means the establishment of the commanded routes and the movements of a work unit and cars during the performance of each item of a train assembly work list, d. said data processing means being jointly responsive to the reception of both the movement reports for said selected work unit and cars and an item completed report from that work unit for checking in accordance with the recorded work list and stored car location data the correctness of the completion of the preceding item on said recorded work list and for activating the transmission of route control functions to establish the required route for the next item on said recorded work list only when the preceding item has been correctly completed.

8. In a railroad terminal control system for an area including at least a classification and a train make-up yard, said system having a central control location with a computer type central data processing means, switching locomotives operable to perform selected work assignments, and a common communication channel between said control location and each of said locomotives, the method of remotely controlling switching locomotive operations, to move railroad cars from existing locations to desired locations in the yards, comprising the steps of, a. recording a work assignment for a switching locomotive in said data processing means, b. transmitting a step-by-step format of the work assignment prepared in accordance with preregistered program instructions by said data processing means over said communication channel to only a single selected locomotive for recording as an itemized work list, c. transmitting a ready-to-work signal over said communication channel from said selected locomotive to said data processing means, d. authorizing the performance of each successive step of said recorded work list with said selected locomotive as the proper yard apparatus conditions are successively established, e. transmitting a step-completed signal from said selected locomotive to said data processing means as each step on said recorded work list is accomplished, f. periodically transmitting control functions to selected yard apparatus from said data processing means in response to the periodic reception of said ready-to-work and step-completed signals, in accordance with the programmed instructions and said recorded work assignment, for successively establishing the yard conditions required to perform the steps of said recorded work list, g. recording in said data processing means indications, of the operations of said selected locomotive as it performs the successive steps of said recorded work list, received from other selected yard apparatus, h. checking by said data processing means, in response to the reception of each step-completed signal from said selected locomotive and the recorded operations indications, the correct completion of the preceding step of said recorded work list prior to the transmission of the control functions for establishing yard apparatus conditions required for the next step of said recorded work list, and i. transmitting from said data processing means a signal authorizing said selected locomotive to perform the next step of said recorded work list, only when the completion of the preceding work step checks correct and the yard apparatus conditions required by the next step are established.

9. In a railroad terminal which includes a storage area for cars and a train assembly area, a car movement control location with a programmed computer type data processing means which stores and processes car information, mobile work units for moving cars between the areas, and a communication network connecting said control location and all said work units, the method of assembling a train comprising the steps of, a. establishing by said data processing means, a work assignment to assemble a selected train comprising selected car blocks, in accordance with the recorded information of car storage locations and programmed instructions preregistered in said data processing means, b. preparing and transmitting an itemized work list, to accomplish said selected train assembly work assignment, from said data processing means to a selected mobile work unit, c. authorizing the performance step-by-step of said itemized work list by said selected work unit, d. transmitting a ready-to-work signal from said selected work unit to said data processing means in response to the reception of said itemized work list, e. transmitting, from said data processing means in response only to the reception of said ready-to-work signal and in accordance with programmed instructions, the control function commands for establishing the track route required to perform the first item of said work list, f. periodically transmitting reports of the completion of each work list item from said selected work unit to said data processing means, g. checking the correct completion of each work list item by said data processing means jointly in accordance with the corresponding periodic completion report and received indications of the selected work unit operations occurring during its performance of the preceding work list item, h. transmitting control function commands from said data processing means to establish the track route required for performing the next work list item when a periodic item complete report checks correct, and i. transmitting a signal from said data processing means authorizing said selected work unit to perform said next step of the recorded work list when said processing means receives other indications that said required track route is established.

10. In a railroad terminal system with mobile work units for moving other vehicles and further including vehicle movement detectors at selected locations within the terminal area, route control apparatus operable for establishing selected routes through a particular switching track layout for vehicle movement, and a digital computer data processor programmed to respond to the registration of a work assignment for selecting in order routes through said particular track layout to enable the successive performance of the steps of that designated work assignment and also programmed for comparing received vehicle movement indications against the corresponding requirements of the registered work assignment to determine completion of each work step, a vehicle movement control arrangement comprising in combination, a. communication apparatus connected for transmitting data and control functions between said computer data processor and said vehicle detectors and route control apparatus, b. control means operable for designating a work assignment, including a series of at least two successive work steps, of moving other vehicles to new locations through said particular track layout, 1. said control means connected for registering each designated work assignment in work step format in said computer data processor, c. said computer data processor connected to said communication apparatus for normally transmitting each successive route selection to said route control apparatus as the prior work step is completed, d. said vehicle movement detectors coupled to said communication apparatus for transmitting indications of vehicle movements to said computer data processor as each work step is performed, e. said computer data processor responsive to vehicle movement indications received during the performance of a particular work step for transmitting the route selection for the succeeding work step only when the requirements of said particular work step have been completed.

11. In a railroad terminal control system, including a programmable digital computer data processor, a plurality of railroad car storage tracks interconnected by a switch network, switching locomotives for moving cars, vehicle detectors at selected locations along said storage tracks and switch network, and route control apparatus for establishing selected routes through said switch network, a method of controlling the movement of cars between storage tracks comprising the steps of, a. entering a selected car movement work assignment for a selected locomotive into said data processor, b. transmitting from said data processor a developed work list format of selected steps to accomplish said selected work assignment for use by the selected locomotive crew, c. controlling from said data processor the switch network to successively establish predetermined routes for said selected locomotive to perform each work step on the transmitted work list in sequence, d. recording within said data processor the movement of said selected locomotive and cars through each established route as detected by said vehicle detectors during the performance of each successive work step, e. checking by said data processor each recorded movement data against the corresponding recorded work step requirement and recording the new location of each moved car, and f. transmitting from said data processor the route controls for a next work step only when the preceding work step is correctly completed.

12. In a railroad yard control system including a programmable data processor which also maintains a data and location inventory of cars stored in the yard, vehicle movement detectors at selected locations within the yard, route control apparatus operable for establishing selected routes for car movements through a track switching network, switching locomotives for moving cars, and communication apparatus connecting said data processor, said vehicle detectors, and said route control apparatus to transmit vehicle movement data and route controls, the method of controlling trimming movements of cars through said switching network comprising the steps of, a. entering into said data processor a sequence of car trimming movements to be performed by a selected switching locomotive within said switching network area, b. registering said entered movement sequence by said data processor as an itemized work list assignment for said selected locomotive, c. selecting in work list order, by said data processor, track routes through said switching network to permit said selected locomotive to successively accomplish said assignment, d. normally transmitting over said communication apparatus each successive route control function from said data processor to said route control apparatus as the prior work list item is completed, e. successively performing each item of said work list by said selected locomotive as each required track route is established, f. transmitting vehicle movement indications from said vehicle detectors over said communication apparatus to said data processor as each work item is performed, g. comparing in said data processor the vehicle movement indications received during a particular work list item with the requirements of that particular item in said registered work assignment in accordance with the stored car inventory to determine correct completion of that particular item, h. enabling the transmission of the route control for the succeeding work list item only when the requirements of said particular work list item have been completed, and i. adjusting the car inventory stored in said data processor in accordance with the received car movement indications.

* * * * *